US006619263B1

(12) United States Patent
Mahr et al.

(10) Patent No.: US 6,619,263 B1
(45) Date of Patent: Sep. 16, 2003

(54) FUEL INJECTION SYSTEM FOR AN INTERNAL COMBUSTION ENGINE

(75) Inventors: Bernd Mahr, Plochingen (DE); Martin Kropp, Korntal-Muenchingen (DE); Hans-Christoph Magel, Pfullingen (DE); Wolfgang Otterbach, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/807,923

(22) PCT Filed: Aug. 2, 2000

(86) PCT No.: PCT/DE00/02551

§ 371 (c)(1),
(2), (4) Date: Aug. 20, 2001

(87) PCT Pub. No.: WO01/14711

PCT Pub. Date: Mar. 1, 2001

(30) Foreign Application Priority Data

Aug. 20, 1999 (DE) ..... 199 39 422

(51) Int. Cl.[7] ..... F02M 41/00
(52) U.S. Cl. ..... 123/447; 123/456
(58) Field of Search ..... 123/447, 448, 123/449, 456, 457, 495, 506

(56) References Cited

U.S. PATENT DOCUMENTS

| | | | | | |
|---|---|---|---|---|---|
| 4,440,132 | A | * | 4/1984 | Terada et al. | 123/446 |
| 4,448,168 | A | * | 5/1984 | Komada et al. | 123/446 |
| 4,459,959 | A | * | 7/1984 | Terada et al. | 123/446 |
| 4,691,674 | A | * | 9/1987 | Otsuka et al. | 123/299 |
| 4,735,185 | A | * | 4/1988 | Imoto et al. | 123/498 |
| 5,299,919 | A | | 4/1994 | Paul et al. | 417/387 |
| 5,355,856 | A | * | 10/1994 | Paul et al. | 123/446 |
| 5,662,087 | A | | 9/1997 | McCandless | 123/446 |
| 5,732,679 | A | * | 3/1998 | Takahasi et al. | 123/447 |
| 5,878,720 | A | | 3/1999 | Anderson et al. | 123/496 |
| 5,979,410 | A | * | 11/1999 | Grieshaber | 123/300 |
| 5,983,863 | A | * | 11/1999 | Cavanagh et al. | 123/447 |
| 6,491,017 | B1 | * | 12/2002 | Mahr et al. | 123/299 |
| 2001/0054411 | A1 | * | 12/2001 | Yildirim et al. | 123/446 |
| 2001/0054412 | A1 | * | 12/2001 | Kojima | 123/456 |
| 2002/0029761 | A1 | * | 3/2002 | Kojima | 123/456 |
| 2002/0088435 | A1 | * | 7/2002 | Kropp et al. | 123/446 |

FOREIGN PATENT DOCUMENTS

| | | | | |
|---|---|---|---|---|
| CH | 616235 | * | 3/1980 | F02M/65/00 |
| DE | 19939422 | * | 3/2001 | F02M/55/02 |
| DE | 19939423 | * | 3/2001 | F02M/45/02 |
| DE | 19939425 | * | 3/2001 | F02M/45/02 |
| DE | 19939428 | * | 3/2001 | F02M/45/02 |
| EP | 0 691 471 A1 | | 1/1996 | |
| EP | 0 711 914 A1 | | 5/1996 | |
| RU | 1997-447129 | * | 3/1997 | F02M/59/00 |

* cited by examiner

*Primary Examiner*—Henry C. Yuen
*Assistant Examiner*—Hai Huynh
(74) *Attorney, Agent, or Firm*—Ronald E. Greigg

(57) ABSTRACT

In a fuel injection system for an internal combustion engine, in which the fuel pumped by means of a high-pressure pump can be injected into the combustion chamber of the engine at at least two different, high fuel pressure via injectors, between the high-pressure pump and the injectors, at least one central pressure booster unit for all the injectors is provided. The pressure booster unit is triggerable in a targeted way as need, and as a result the fuel which is at the higher pressure can be better regulated in quantity, and the losses from friction can be reduced accordingly as well.

11 Claims, 30 Drawing Sheets

FUEL INJECTION SYSTEM FOR AN INTERNAL COMBUSTION ENGINE

CROSS-REFERENCE TO RELATED APPLICATIONS

This application a 35 USC 371 application of PCT/DE 00/02551 filed on Aug. 2, 2000.

BACKGROUND OF THE INVENTION

1. Field of the Invention

The invention is based on a fuel injection system for an internal combustion engine and particularly to such a system in which fuel can be injected into a combustion chamber at two different pressures.

2. Description of the Prior Art

An injection system of the type with which this invention is concerned has been disclosed for instance by European Patent Disclosure EP 0 711 914 A1.

For better comprehension of the ensuing description, several terms used herein will first be defined in detail: In a pressure-controlled fuel injection system, by means of the fuel pressure prevailing in the nozzle chamber of an injector, a valve body (such as a nozzle needle) is opened counter to the action of a closing force, and the injection opening is thus uncovered for an injection of the fuel. The pressure at which fuel emerges from the nozzle chamber into the cylinder is called the injection pressure, while the term system pressure is understood to mean the pressure at which fuel is kept available or stored in the injection system. The term stroke-controlled fuel injection system is understood within the scope of the invention to mean that the opening and closing of the injection opening of an injector is done with the aid of a displaceable valve member on the basis of the hydraulic cooperation of the fuel pressures in a nozzle chamber and in a control chamber. Furthermore, an assembly is called central when it is provided jointly for all the cylinders, and local when it is provided for only a single cylinder.

In the pressure-controlled fuel injection system known from EP 0 711 914 A1, with the aid of a high-pressure pump, fuel is compressed to a first high fuel pressure of about 1200 bar and stored in a first pressure reservoir. The fuel at high pressure is also pumped into a second pressure reservoir, in which by regulation of its fuel delivery by means of a 2/2-way valve, a second high fuel pressure of about 400 bar is maintained. Via a valve control unit, either the lower or the higher fuel pressure is carried into the nozzle chamber of an injector. There, by the pressure, a spring-loaded valve body is lifted from its valve seat, so that fuel can emerge from the nozzle opening.

A disadvantage of this known fuel injection system is that first all the fuel has to be compressed to the higher pressure level, and then some of the fuel has to be relieved to the lower pressure level again. Furthermore, since the high-pressure pump is driven by the engine camshaft, it is constantly in operation, even if the desired pressure in the applicable pressure reservoir has already been built up. This constant generation of high pressure and later relief to the low pressure level worsen the efficiency.

SUMMARY OF THE INVENTION

According to the invention, it is proposed that a higher pressure level be generated by means of a central pressure booster unit. The pressure booster unit, since it is independent of the camshaft, can be triggered in a targeted way on demand, and as a result the high pressure can be better regulated in terms of quantity. Since the pressure booster unit is not constantly in operation, the losses from friction are reduced accordingly as well.

If the high-pressure side and the low-pressure side of the central pressure booster unit are hydraulically decoupled from one another, then different fuels can be used for the two sides, such as oil for the low-pressure side and gasoline or Diesel fuel for the high-pressure side.

BRIEF DESCRIPTION OF THE DRAWINGS

Further advantages and advantageous features of the subject of the invention can be learned from the description contained below, taken with the drawings, in which.

DESCRIPTION OF THE PREFERRED EMBODIMENTS

Figure 1A:
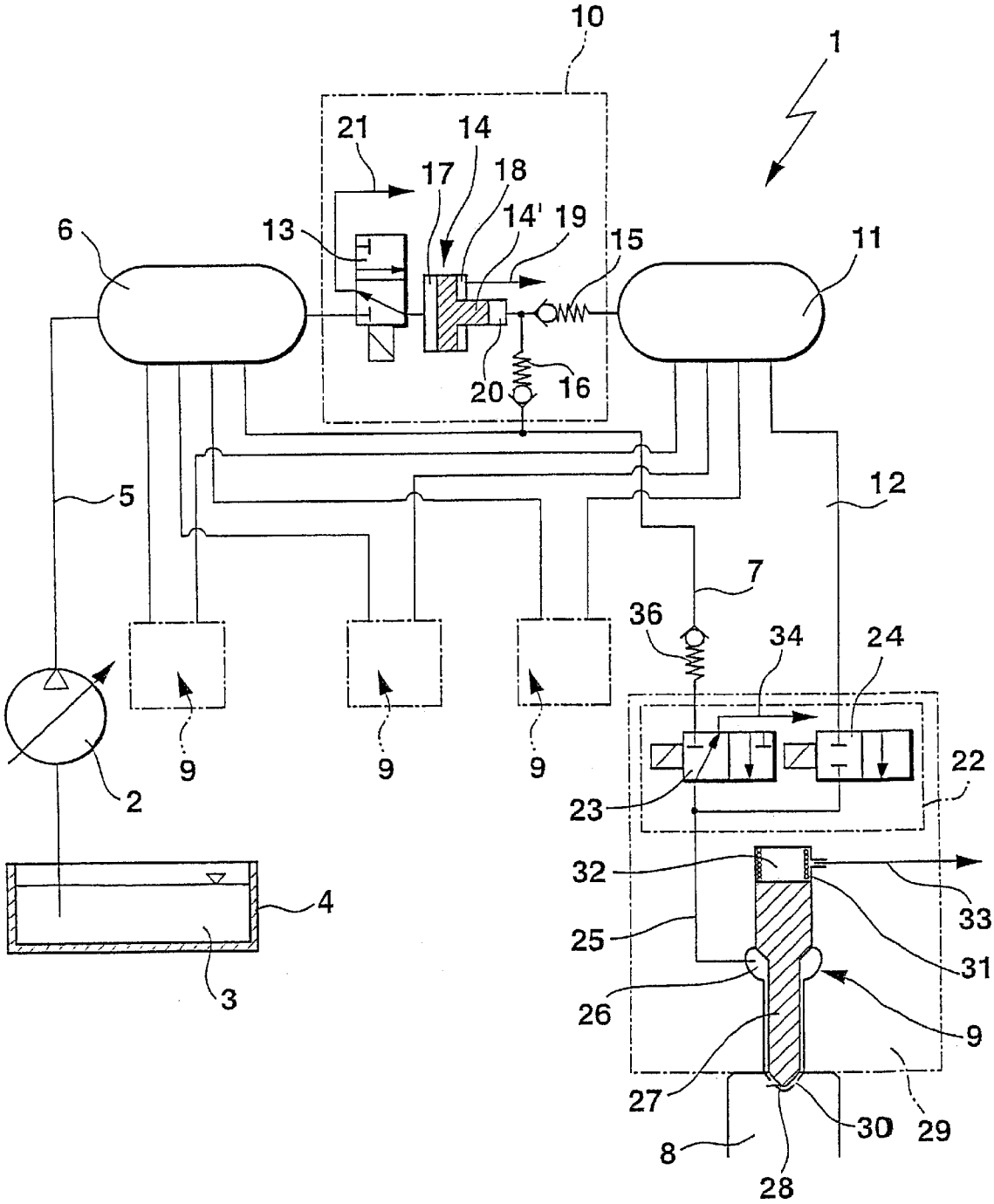
FIGS. 1*a* and 1*b* schematically illustrate a pressure-controlled fuel injection system for an injection at two, differently high fuel pressures, with a central pressure booster unit between two central pressure reservoirs and with one local valve assembly for each injector.
Figure 1B:
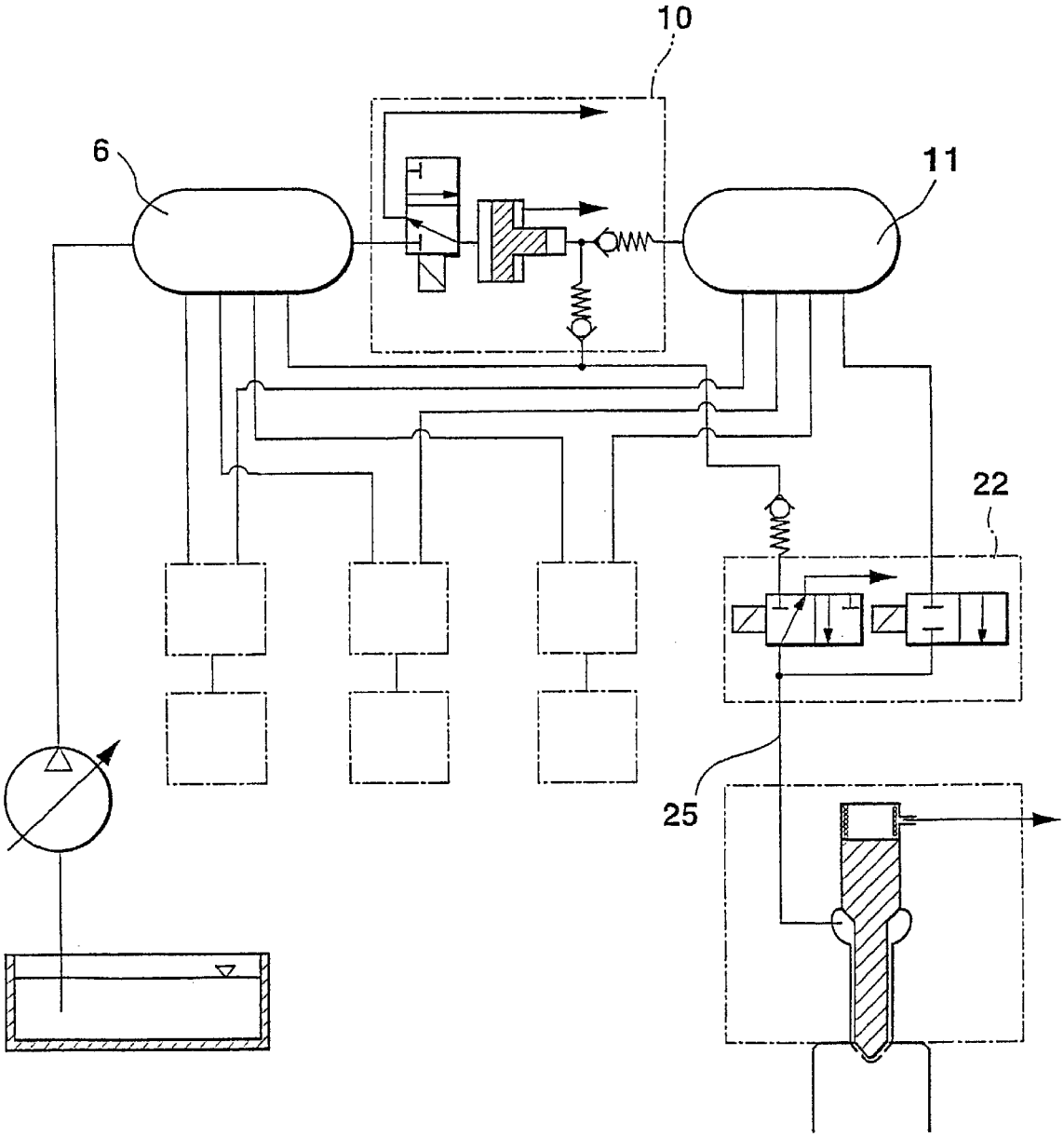

In the first exemplary embodiment of a pressure-controlled fuel injection system 1, shown in FIGS. 1*a* and 1*b*, a quantity-regulated fuel pump 2 pumps fuel 3 out of a tank 4 via a feed line 5 into a first central pressure reservoir 6 (common rail), from which a plurality of pressure lines 7, corresponding in number to the number of individual cylinders, lead away to the individual pressure-controlled injectors 9 (injection devices) that protrude into the combustion chamber 8 of the internal combustion engine to be supplied. With the aid of the fuel pump 2, a first (lower) fuel pressure (for instance about 300 bar) is thus generated and stored in the first pressure reservoir 6 (common rail). This fuel pressure can be used for pre-injection and as needed for post-injection (hydrocarbon enrichment for exhaust gas post-treatment) and to characterize a course of injection with a plateau (boot injection). The first pressure reservoir 6 is followed by a central pressure booster unit 10, by means of which fuel from the first pressure reservoir 6 is compressed to a second, higher fuel pressure for a main injection. The higher fuel pressure is stored in a second pressure reservoir 11 (common rail), from which again a plurality of pressure lines 12, corresponding in number to the number of cylinders, lead away to the individual injectors 9. In this pressure reservoir 11, a fuel pressure of about 300 bar to 1800 bar can be stored.

The pressure booster unit 10 includes a valve unit 13 for triggering pressure boosting, a pressure booster 14 with a pressure means 14' in the form of a displaceable piston element, and two check valves 15 and 16. The pressure means 14' can be connected by one end, with the aid of the valve unit 13, to the first pressure reservoir 6, so that on one end it is acted upon by pressure by means of the fuel located in a primary chamber 17. A differential chamber 18 is pressure-relieved by means of a leakage line 19, so that the pressure means 14' can be displaced in the compression direction to reduce the volume of a pressure chamber 20. As a result, the fuel located in the pressure chamber 20 is compressed to a second, higher fuel pressure in accordance with the ratio of the areas of the primary chamber 17 and pressure chamber 20 and delivered to the second pressure reservoir 11. The check valve 15 prevents the return flow of compressed fuel out of the second pressure reservoir 11. If the primary chamber 17, with the aid of the valve unit 13, is connected to a leakage line 21, then the restoration of the pressure means 14' and the refilling of the pressure chamber 20, which is connected to the pressure line 7 via the check valve 16, take place. On the basis of the pressure ratios in the primary chamber 17 and pressure chamber 20, the check valve 16 opens, so that the pressure chamber 20 is at the first fuel pressure (rail pressure of the first pressure reservoir 6), and the pressure means 14' is returned hydraulically to its outset position. To improve the restoration performance, one or more springs can be disposed in the chambers 17, 18 and 20. In the exemplary embodiment shown, the valve unit 13 is shown, purely as an example, as a 3/2-way valve.

Fuel metering at either the lower or the higher fuel pressure is done separately for each cylinder or injector 9, specifically via a respective local valve assembly 22, which in the exemplary embodiment shown is embodied by a 3/2-way valve 23 for the lower fuel pressure and a 2/2-way valve 24 for the higher fuel pressure. The respective prevailing pressure is then carried via a pressure line 25 into a nozzle chamber 26 of the injector 9. The injection is done under pressure control with the aid of a pistonlike valve member 27 (nozzle needle), which is displaceable axially in a guide bore and whose conical valve sealing face 28 cooperates with a valve seat face on the injector housing 29 and thus closes the injection openings 30 provided there. Inside the nozzle chamber 26, a pressure face of the valve member 27, pointing in the opening direction of the valve member 27, is exposed to the pressure prevailing there, and the nozzle chamber 26 continues across an annular gap between the valve member 27 and the guide bore, up to the valve sealing face 28 of the injector 9. By the pressure prevailing in the nozzle chamber 26, the valve member 27 that seals off the injection openings 30 is opened, counter to the action of a closing force (closing spring 31), and the spring chamber 32 is pressure-relieved by means of a leakage line 33. The injection at the lower fuel pressure takes place, with the 2/2-way valve 24 currentless, by means of supplying current to the 3/2-way valve 23. The injection at the higher fuel pressure, with current being supplied to the 3/2-way valve 23, takes place by the provision of current to the 2/2-way valve 24, and a check valve 36 prevents an unintended return to the pressure line 7. At the end of injection, with the 2/2-way valve 24 currentless, the 3/2-way valve 23 is switched to leakage line 34. As a result, the pressure line 25 and the nozzle chamber 26 are pressure-relieved, so that the spring-loaded valve member 27 closes the injection openings 30 again.

The local valve assembly 22 can be disposed either inside the injector housing 29 (FIG. 1*a*), or outside the injector housing, as shown in FIG. 1*b*, for instance in the region of the pressure reservoirs 6, 11. In this way a smaller structural size of the injector housing can be achieved, and by utilizing wave reflections in what is now a longer pressure line 25, an elevated injection pressure is also attainable.

In the description of the other drawings, only the differences from the fuel injection system of FIG. 1 will be addressed below. Identical or functionally identical components are identified by the same reference numerals and will not be described in detail again.

Figure 2A:
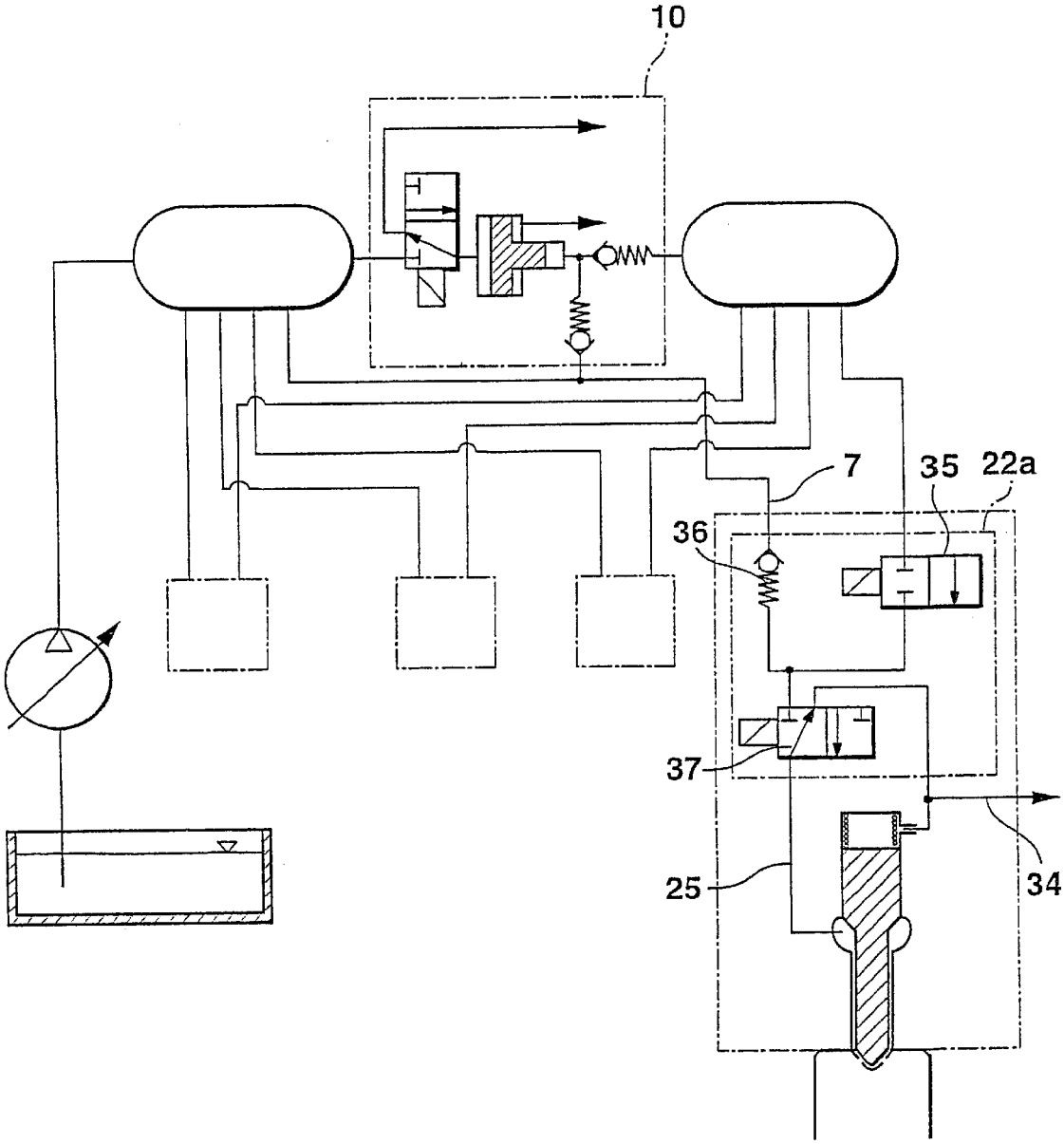
FIGS. 2*a* and 2*b* illustrate the fuel injection system of FIG. 1 with a modified local valve assembly.
Figure 2B:
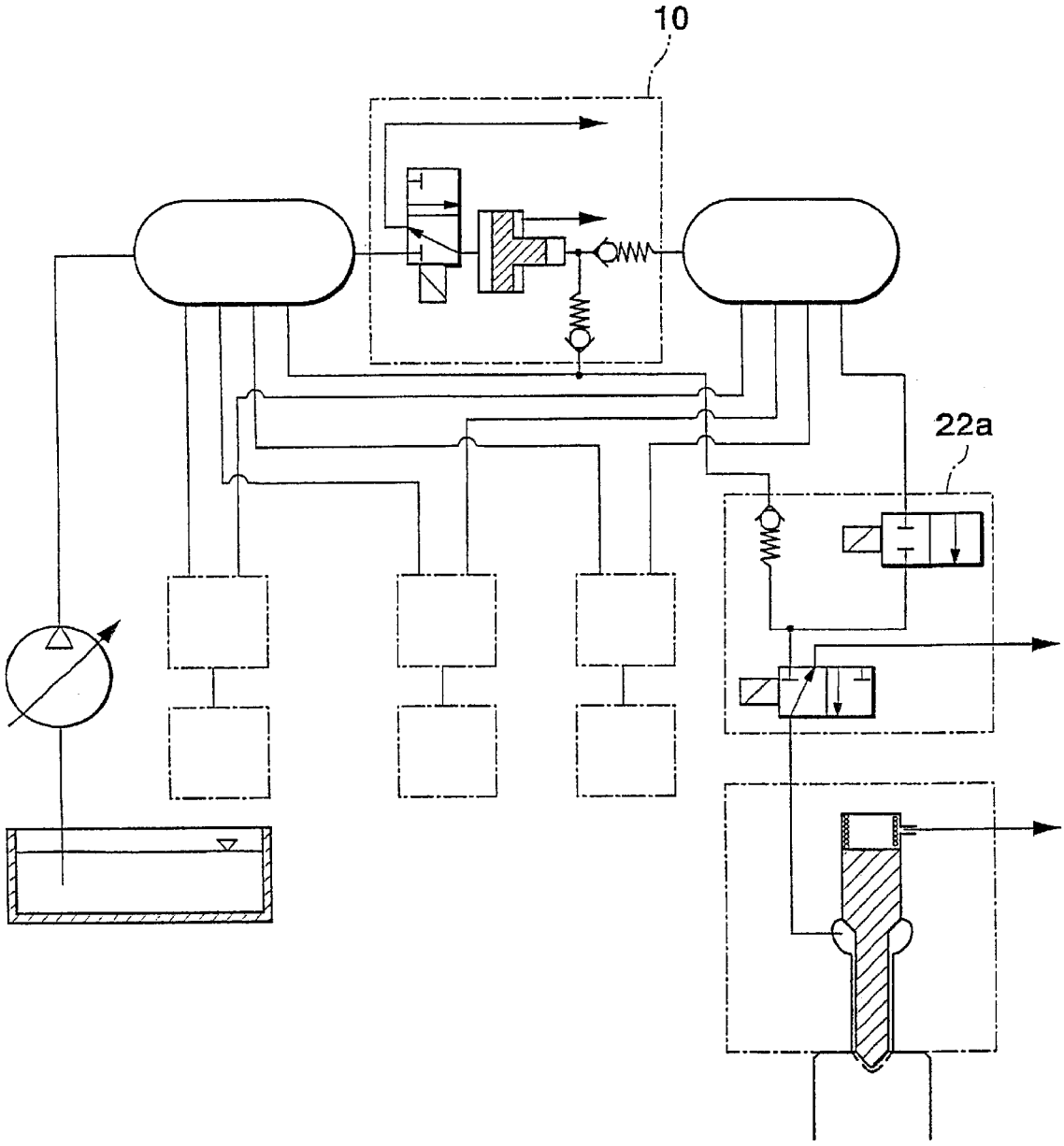

FIGS. 2*a* and 2*b* show another local valve assembly 22*a*, which can be disposed either inside the injector housing (FIG. 2*a*) or outside the injector housing (FIG. 2*b*). This local valve assembly 22*a* includes a 2/2-way valve 35 as a switching element for the higher fuel pressure, a check valve 36 in the pressure line 7, and for switching whatever pressure prevails, a 3/2-way valve 37 in the pressure line 25. An injection at the lower fuel pressure takes place, with the 2/2-way valve 35 currentless, by the supplying of current to the 3/2-way valve 37. By supplying current to the 2/2-way valve 35 as well, a switchover can be made to an injection at the higher fuel pressure, and the check valve 36 prevents an unintended return to the pressure line. At the end of injection, the 3/2-way valve 37 is switched back to leakage 34.

Figure 3A:
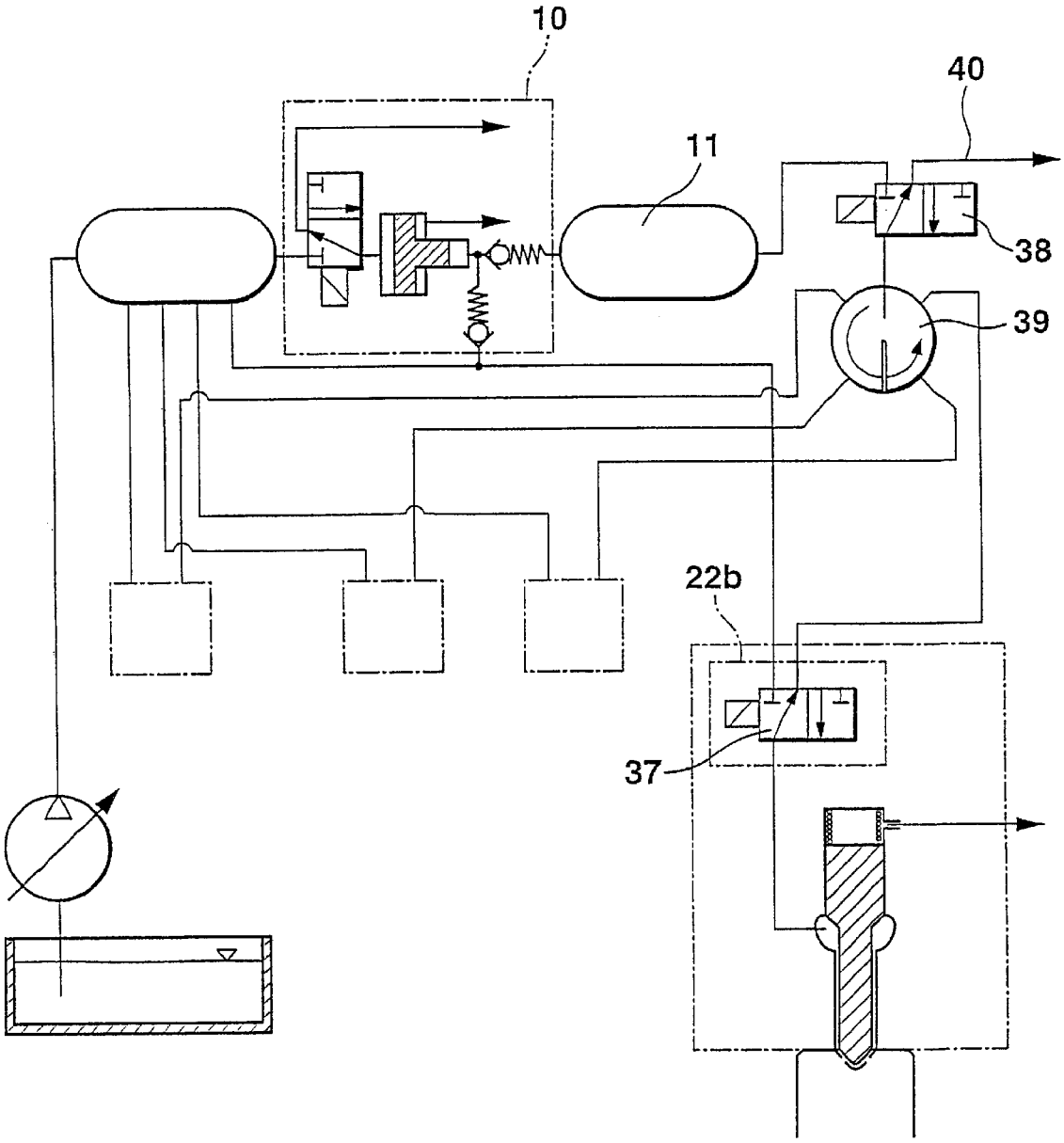
FIGS. 3*a* and 3*b* illustrate the fuel injection system of FIG. 1 with a central distributor device for the higher fuel pressure and with a modified local valve assembly.
Figure 3B:
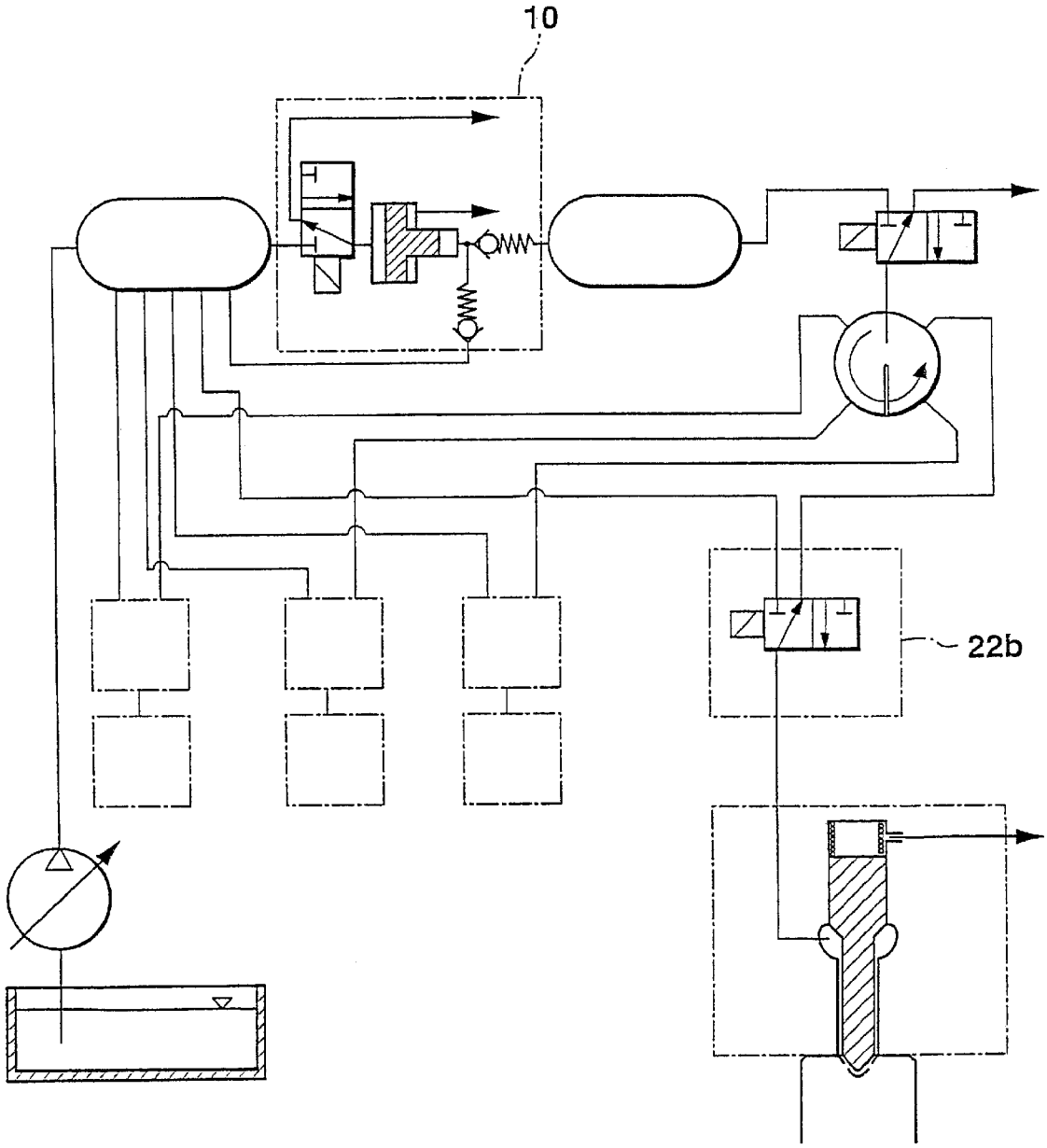

In FIGS. 3*a* and 3*b*, the fuel from the second pressure reservoir 11 is distributed, controlled via a central valve unit 38 (such as a 3/2-way valve), centrally via a distributor device 39 to the individual pressure-controlled injectors. The injection at the lower fuel pressure takes place, with the valve unit 38 currentless, by supplying current to the 3/2-way valve 37, which by itself forms the local valve assembly 22*b*. The injection at the higher fuel pressure takes place via the distributor device 39, with the valve unit 37 currentless and with the central valve unit 38 supplied with current. At the end of this injection, the central valve unit 38 is switched back to leakage 40, and thus the distributor device 39 and the injector are relieved. The local valve unit 22*b* can either be part of the injector housing (FIG. 3*a*) or be located outside the injector housing (FIG. 3*b*).

Figure 4:
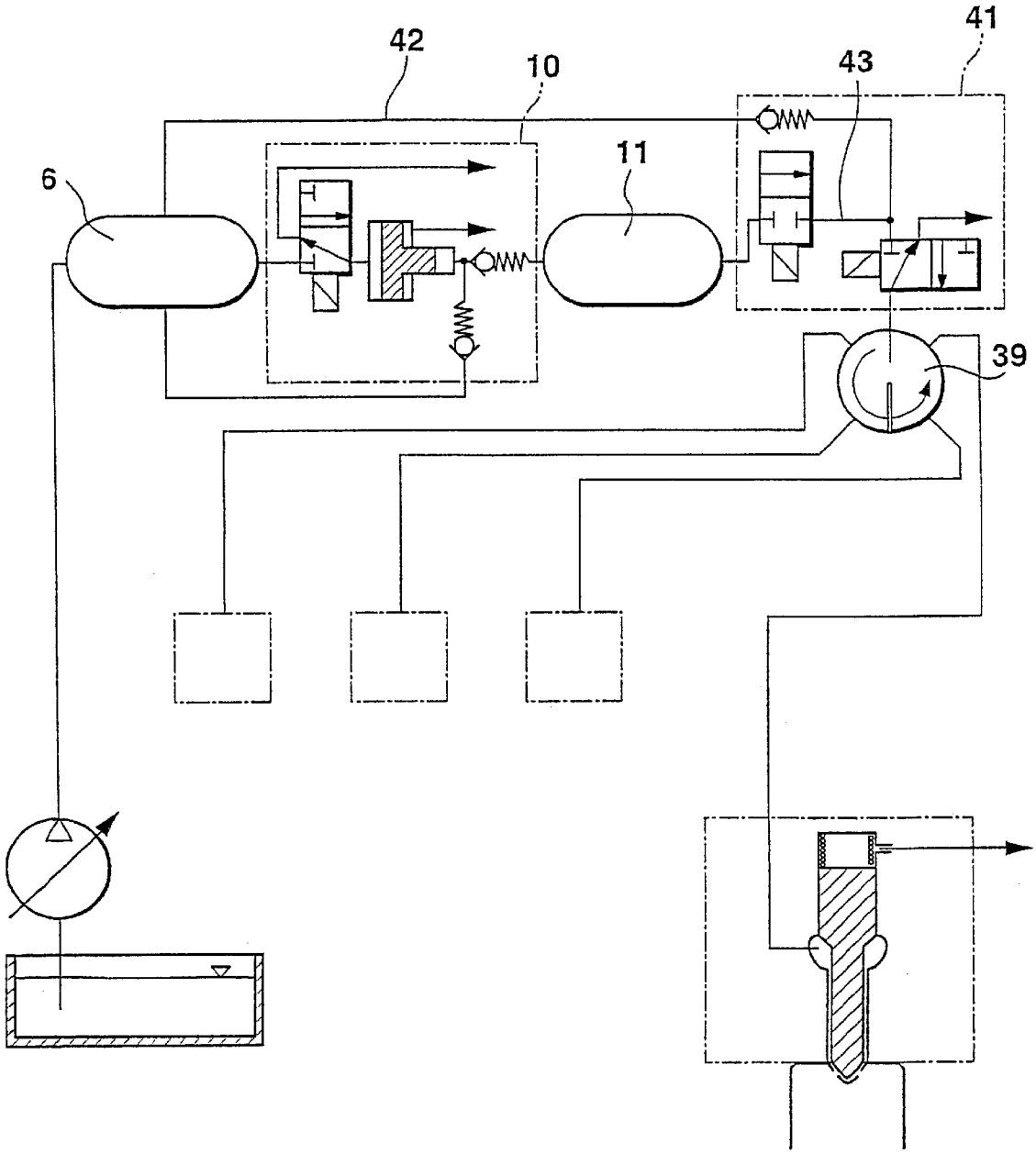
FIG. 4 illustrate the fuel injection system of FIG. 3, in which the lower fuel pressure is also metered by means of the central distributor device.

In FIG. 4 it is shown that unlike FIGS. 3*a* and 3*b*, the lower fuel pressure can also be metered centrally by means of the distributor device 39. The fuel metering at either the lower or the higher fuel pressure is effected here by means of a centrally disposed valve assembly 41, which connects either the pressure line 42 leading away from the first pressure reservoir 6 or the pressure line 43 leading away from the second pressure reservoir 11 to the central distributor device 39. The central valve assembly 41 is constructed analogously to the local valve assembly 22*a* (FIGS. 2*a* and 2*b*).

Figure 5A:
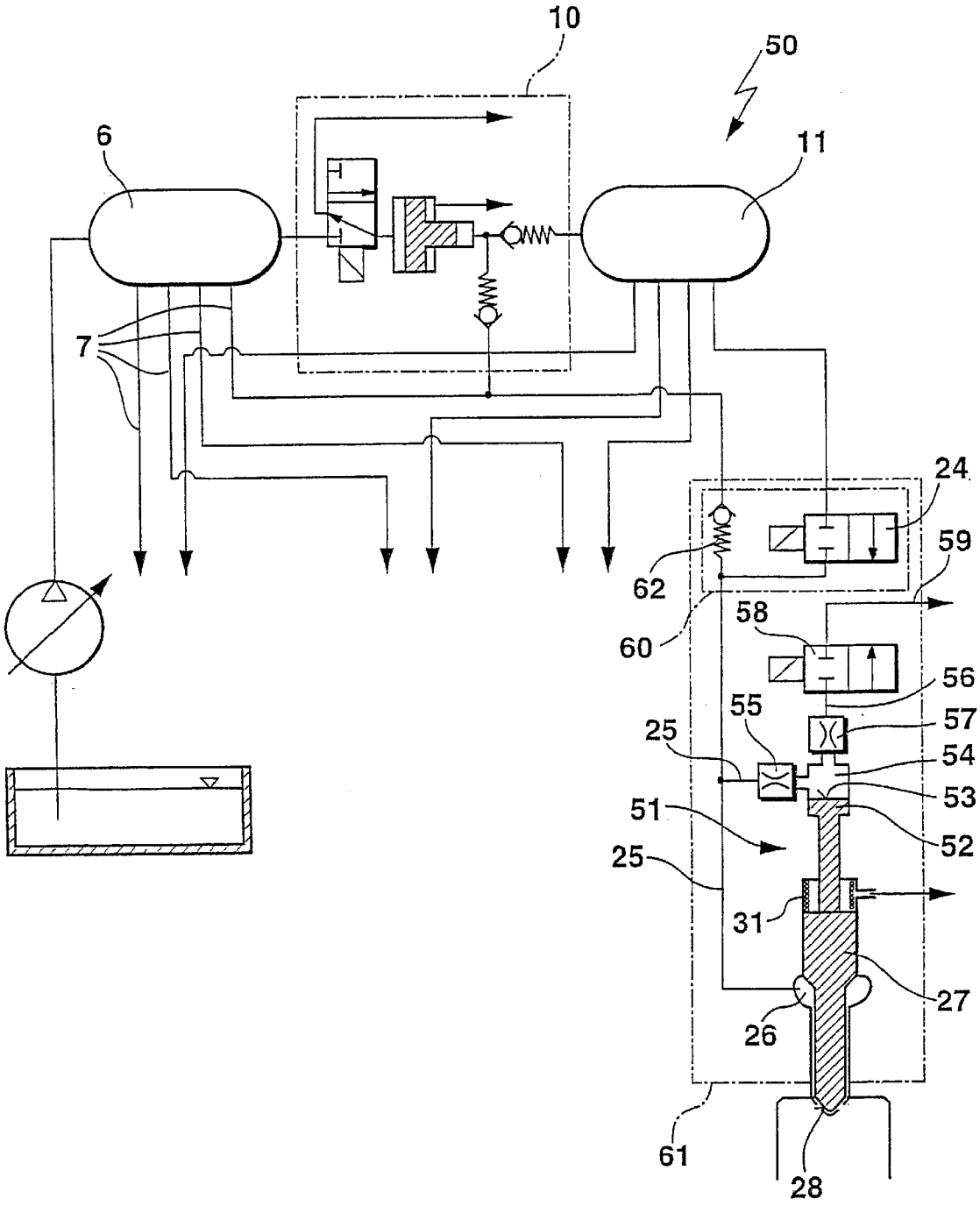
FIGS. 5*a* and 5*b* schematically illustrate a stroke-controlled fuel injection system for an injection at two, differently high fuel pressures, with a central pressure booster unit between two central pressure reservoirs and with a local valve assembly.
Figure 5B:
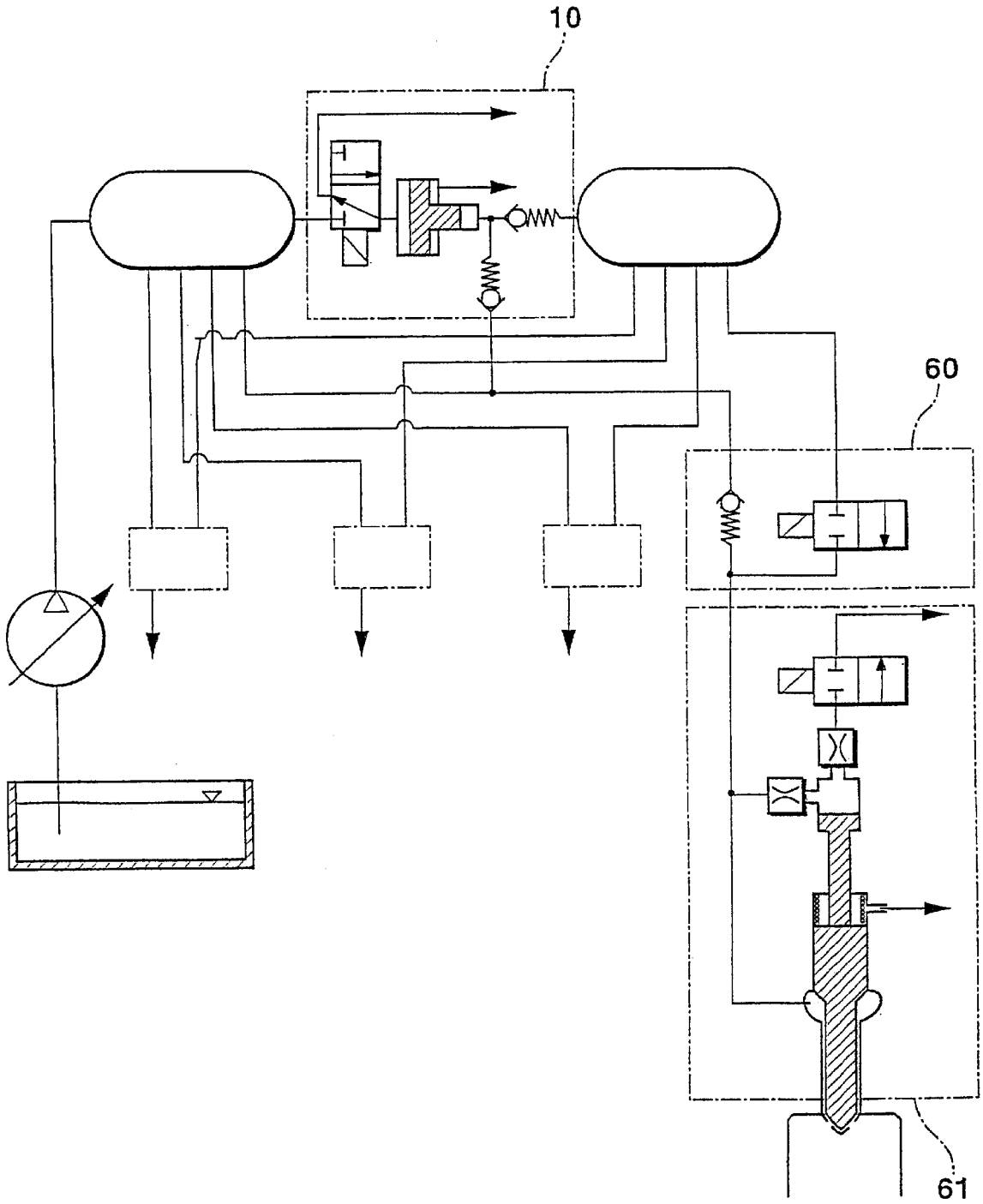

Unlike the situation in the pressure-controlled fuel injection system 1 of FIGS. 1*a* and 1*b*, the injection in the fuel injection system 50 shown in FIGS. 5*a* and 5*b* takes place with stroke control, by means of stroke-controlled injectors 51, only one of which is shown in detail. Beginning with the pressure-controlled injector 9 of FIGS. 1*a* and 1*b*, in the case of a stroke-controlled injector 51 the valve member 27 is engaged coaxially to the valve spring 31 by a pressure piece 52, which with its face end 53 remote from the valve sealing face 28 defines a control chamber 54. From the pressure line 25, the control chamber 54 has a fuel inlet with a first throttle 55 and a fuel outlet to a pressure relief line 56 with a second throttle 57, which is controllable to leakage 59 by means of a 2/2-way valve 58. Via the pressure in the control chamber 54, the pressure piece 52 is urged in the closing direction. Fuel at the first or second fuel pressure constantly fills the nozzle chamber 26 and the control chamber 54. Upon actuation (opening) of the 2/2-way valve 58, the pressure in the control chamber 54 can be reduced, so that as a consequence, the pressure force in the nozzle chamber 26 exerted on the valve member 27 in the opening direction exceeds the pressure force acting on the valve member 27 in the closing direction. The valve sealing face 28 lifts from the valve seat face, and fuel is injected. Thus the pressure relief process of the control chamber 54 and thus the stroke control of the valve member 27 can be varied by way of the dimensioning of the two throttles 55 and 57. The end of the injection is initiated by reactuation (closure) of the 2/2-way valve 58, which decouples the control chamber 54 from the leakage line 59 again, so that a pressure that is capable of moving the pressure piece 52 in the closing direction builds up again in the control chamber 54. The switchover of the fuel to either the lower or the higher fuel pressure is done locally for each injector 51 by means of a valve assembly 60, which is formed of a 2/2-way valve 24 and a check valve 62 that prevents an unintended return into the pressure line 7. The valve assembly can be disposed either inside the injector housing 61 (FIG. 5*a*) or outside it (FIG. 5*b*). For metering the fuel, the 2/2-way valve 58 is used for both pressures.

Figure 6:
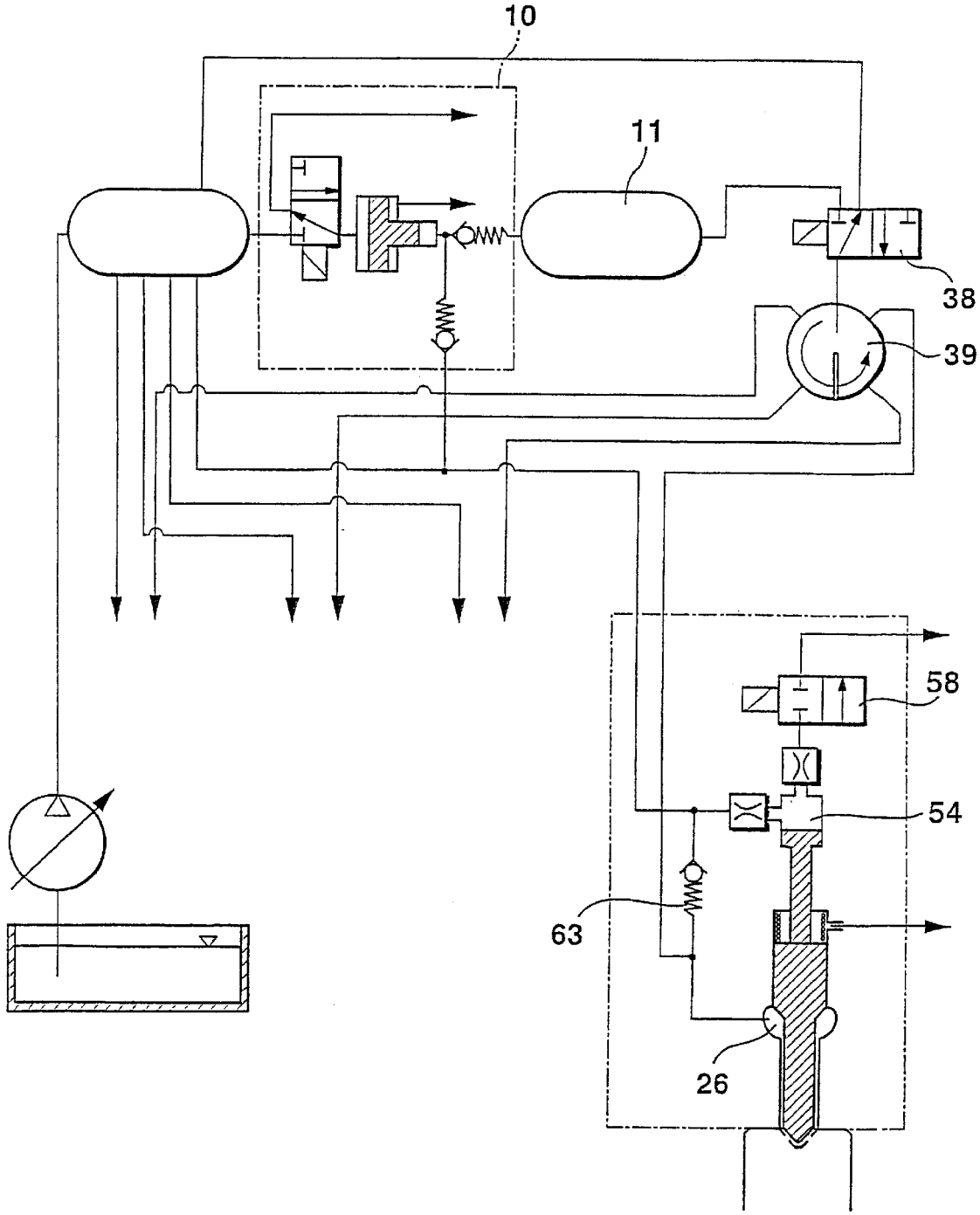
FIG. 6 illustrates the fuel injection system of FIG. 5, but with a central distributor device for the higher fuel pressure.

In FIG. 6; it is shown that unlike FIGS. 5*a* and 5*b*, the higher fuel pressure can, as in FIG. 3*a*, also be metered centrally via the distributor device 39. With the central valve unit 38 currentless, the nozzle chamber 26 and control chamber 54 are filled with fuel from the first pressure reservoir 6, so that the fuel injection takes place at the lower fuel pressure. With the central valve unit 38 supplied with current, only the nozzle chamber 26 communicates with the second pressure reservoir 11, because of the check valve 63, and thus the fuel injection takes place at the higher fuel pressure. For injection at the lower fuel pressure, the 2/2-way valve 58 is opened. By activating the 3/2-way valve 38, the fuel is metered at high pressure; the opening at the lower fuel pressure is done under stroke control and at the higher fuel pressure under pressure control.

Figure 7:
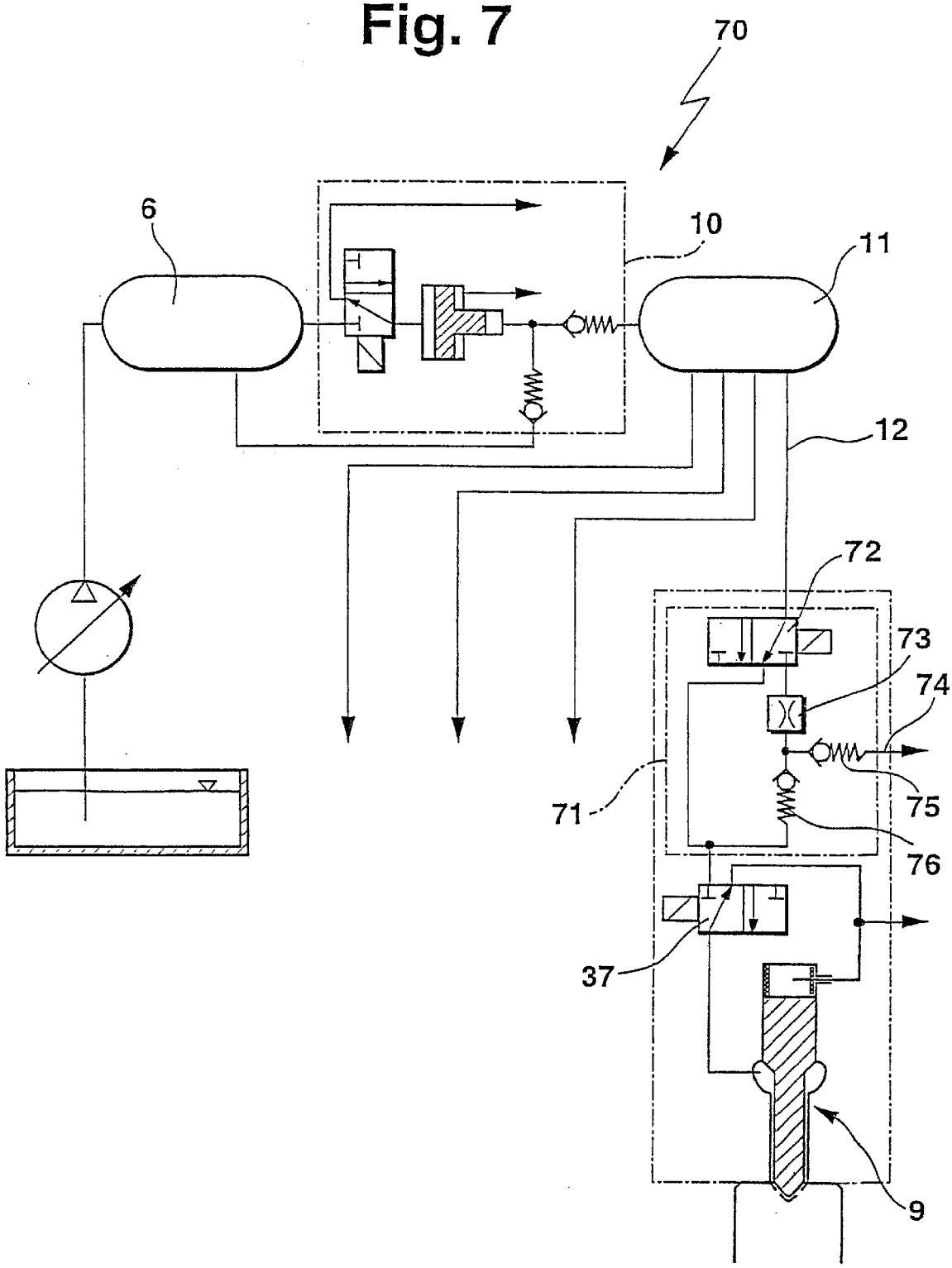
FIG. 7 schematically illustrates a pressure-controlled fuel injection system, in which the higher fuel pressure can be lowered to a lower fuel pressure by means of a local diversion unit.

FIG. 7 shows a pressure-controlled injection system 70, in which unlike FIGS. 2*a* and 2*b*, the fuel stored in the first pressure reservoir 6 is not carried away for an injection. The fuel from the second pressure reservoir 11 is delivered via the pressure line 12 to each individual injector 9 in the form of higher fuel pressure, which as needed can be lowered to the lower fuel pressure by means of a local diversion unit 71. In the exemplary embodiment shown, the diversion unit 71 includes a 3/2-way valve 72, so that the higher fuel pressure can either be switched through or diverted dissipatively by means of a throttle 73 and a pressure limiting check valve 75, the latter being set to the lower fuel pressure and communicating with a leakage line 74. The prevailing pressure in each case is then carried on as in FIG. 2 to the injector 9 via the 3/2-way valve 37, and a check valve 76 prevents an outflow of the higher fuel pressure via the check valve 75.

Figure 8:
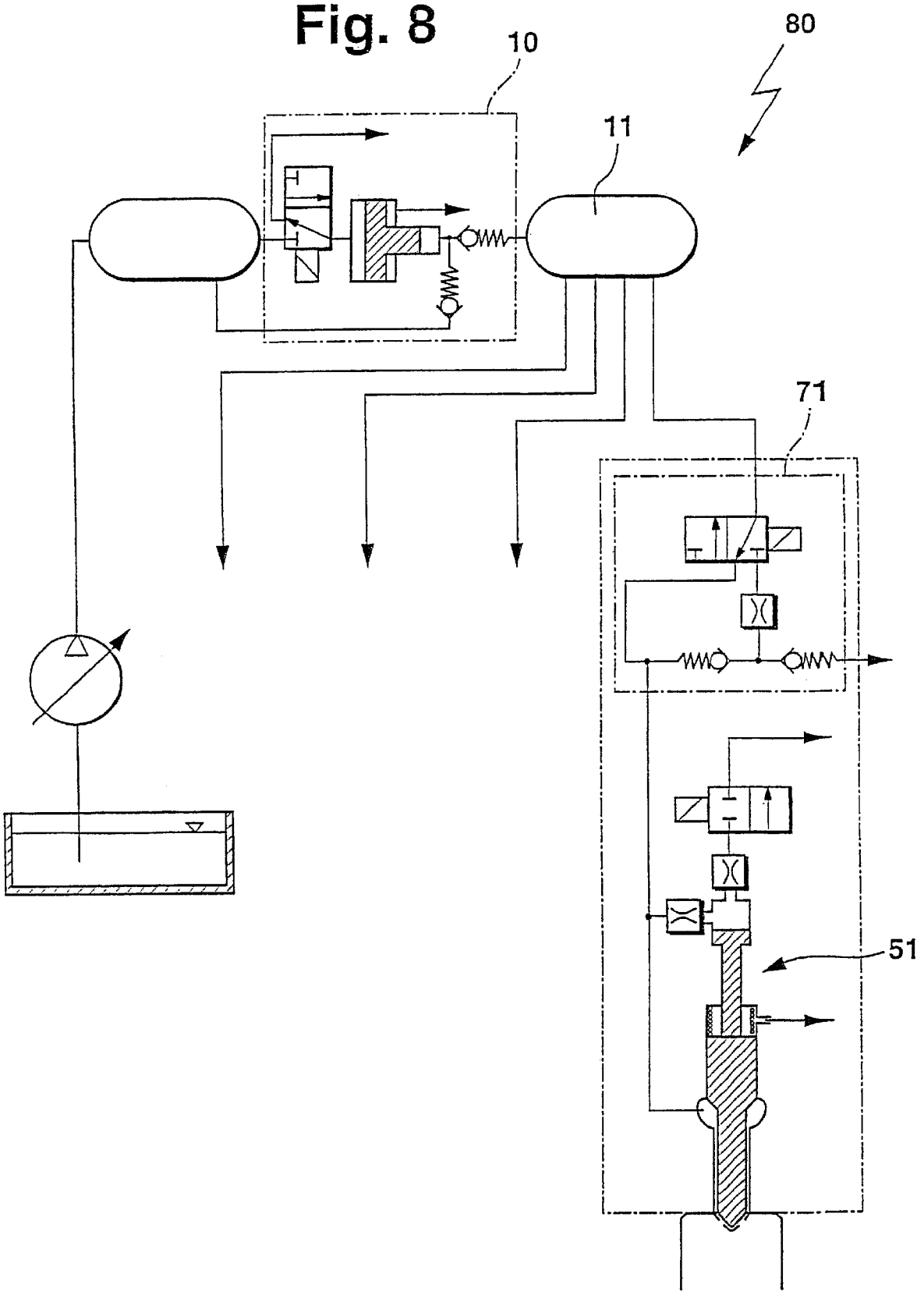
FIG. 8 schematically illustrates a fuel injection system corresponding to that of FIG. 7, but stroke-controlled.

FIG. 8 shows an injection system 80 corresponding to FIG. 7, but stroke-controlled, in which the fuel from the second pressure reservoir 11 can be reduced to the lower fuel pressure via the local diversion unit 71. The injection takes place via the stroke-controlled injectors 51.

Figure 9A:
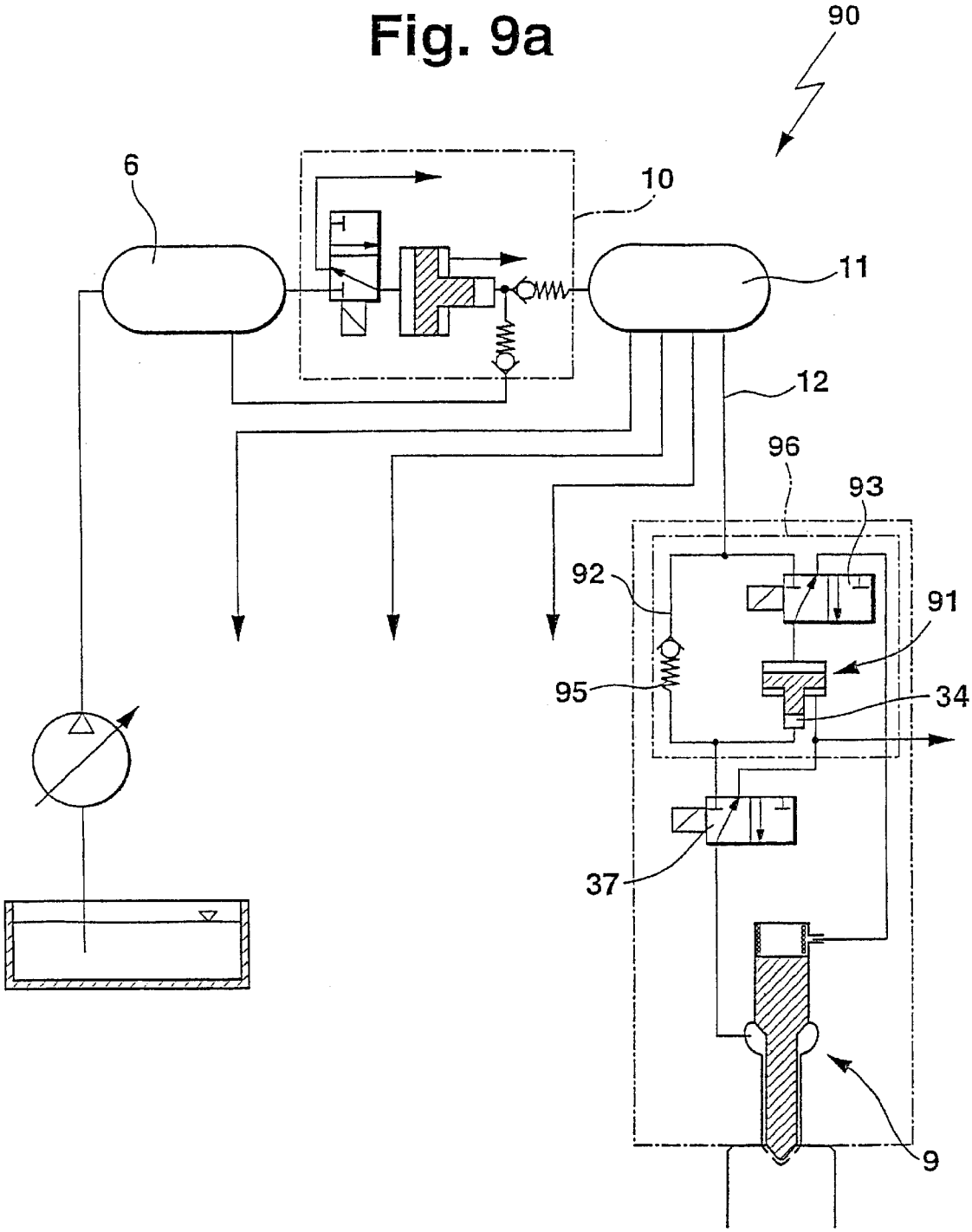
FIGS. 9*a* and 9*b* schematically illustrate a pressure-controlled fuel injection system, in which a higher fuel pressure can be generated by means of a local pressure booster unit.
Figure 9B:
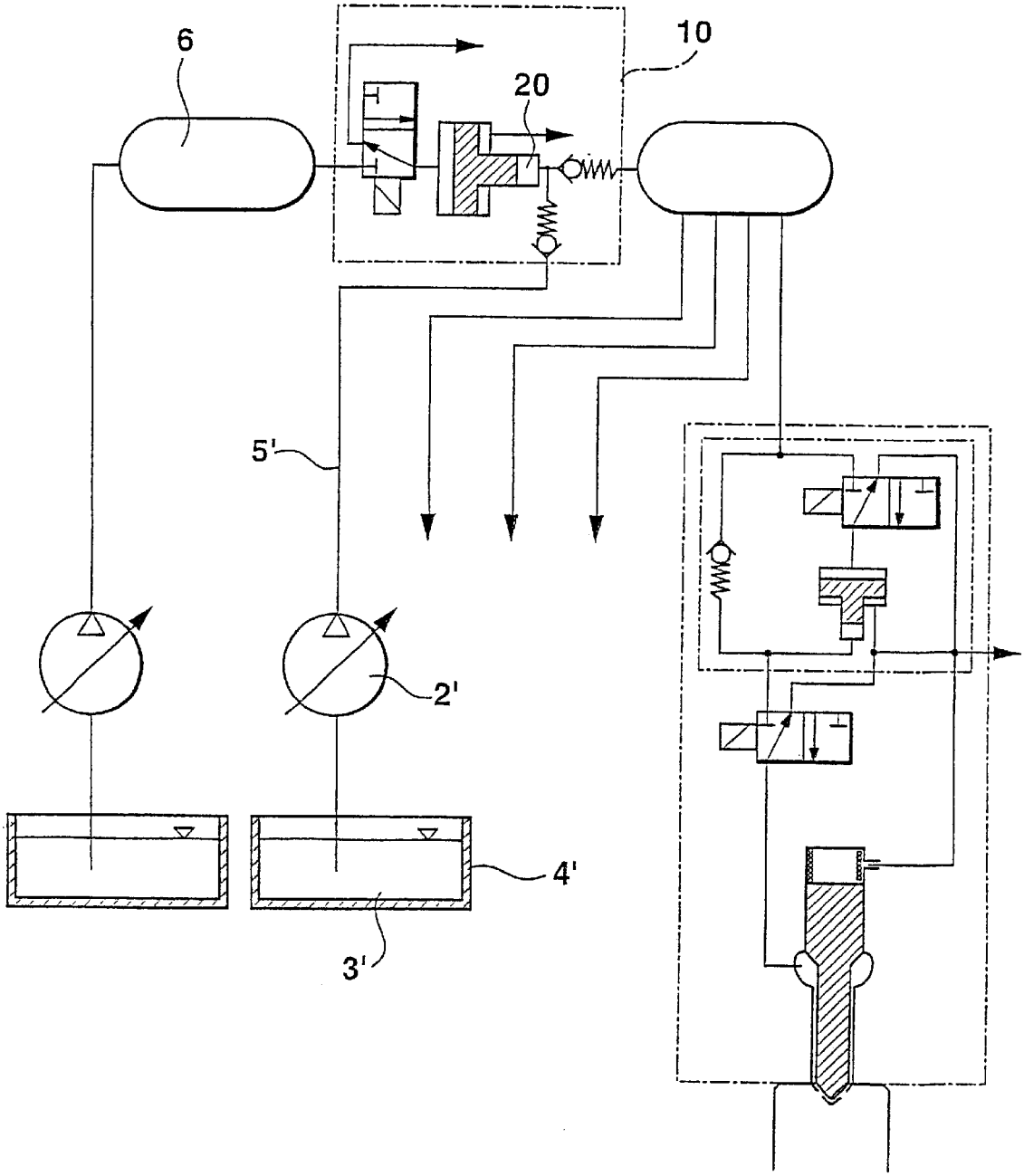

In the pressure-controlled fuel injection system 90 of FIGS. 9*a* and 9*b*, unlike the injection system 70 (FIG. 7), the fuel pressure stored in the second pressure reservoir 11 is utilized as the lower fuel pressure. From it, a higher fuel pressure can then also be generated as needed by means of a local pressure booster 91, which is disposed in a bypass line 92 of the pressure line 12. By means of a valve unit 93 (3/2-way valve) in the bypass line 92, the local pressure booster 91, which is constructed analogously to the central pressure booster 14, can be activated. The pressure chamber 94 of the local pressure booster 91 is filled with fuel from the second pressure reservoir 11, and a check valve 95 prevents the return of compressed fuel back into the second pressure reservoir 11. The pressure booster 91, valve unit 93 and check valve 95 form the local pressure booster unit 96, which in the exemplary embodiment shown is located inside the injector housing. The fuel metering at the prevailing fuel pressure is done via the 3/2-way valve 37, by means of pressure-controlled injectors 9. As FIG. 9*b* shows, the pressure chamber 20 of the central pressure booster unit 10 can be filled, instead of with fuel from the first pressure reservoir 6 as in FIG. 9*a*, with fuel 3', which is pumped by a quantity-regulated fuel pump 2' via a feed line 5' out of a further tank 4' into the pressure chamber 20. Since the high-pressure side and the low-pressure side of the central pressure booster unit are hydraulically decoupled from one another, it is also possible for different fuels to be used for the two sides, such as oil for the low-pressure side and gasoline or Diesel fuel for the high-pressure side.

Figure 10A:
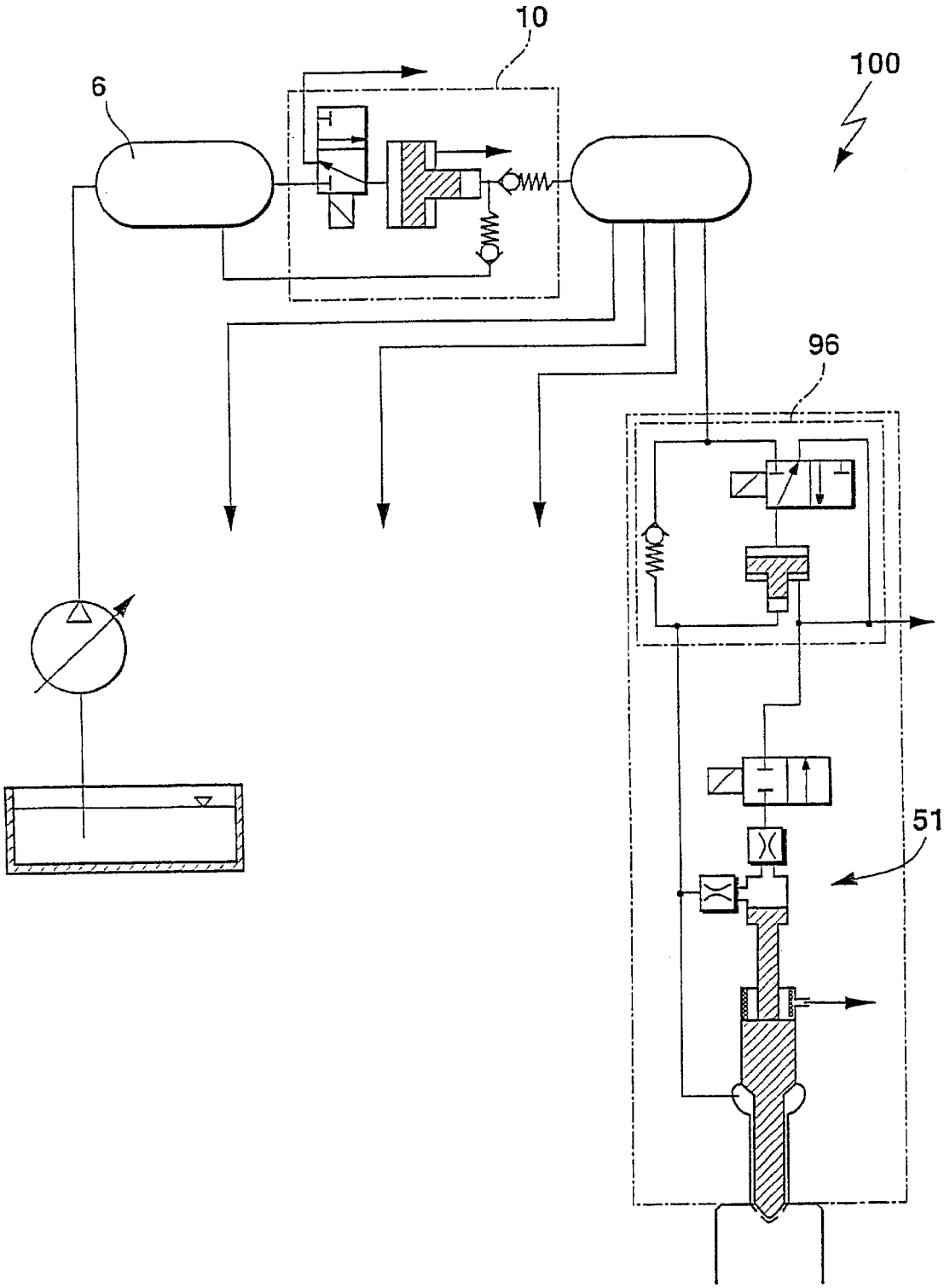
FIGS. 10*a* and 10*b* schematically illustrate a fuel injection system corresponding to FIG. 9, but stroke-controlled.
Figure 10B:
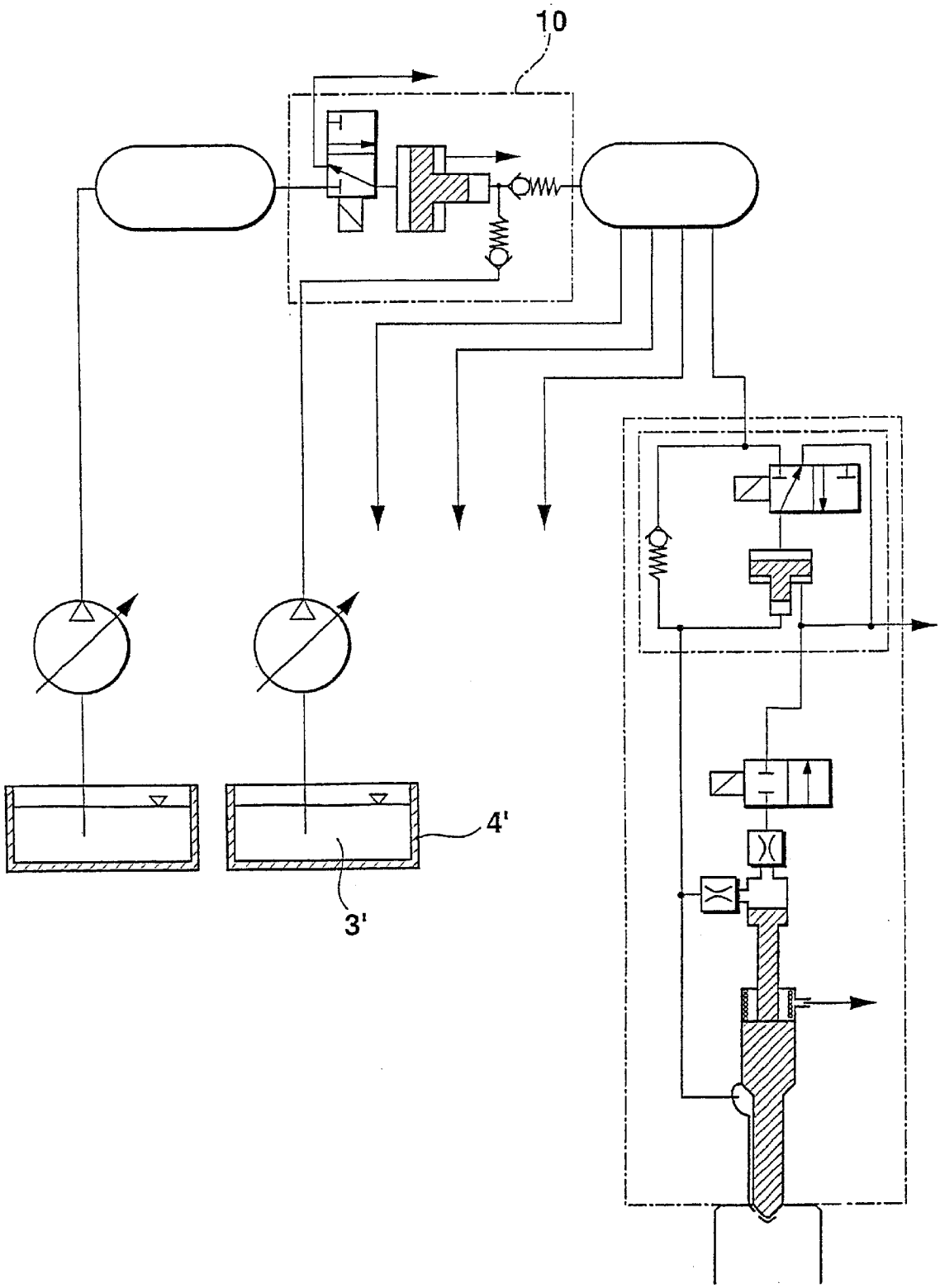

The injection system 100 of FIGS. 10*a* and 10*b* with its local pressure booster unit 96 corresponds to the injection system 90 (FIGS. 9*a* and 9*b*), but with stroke-controlled injectors 51. The filling of the central pressure booster unit 10 takes place either with the fuel from the first pressure reservoir 6 (FIG. 10*a*) or with the fuel 3' from the further tank 4' (FIG. 10*b*).

Figure 11:
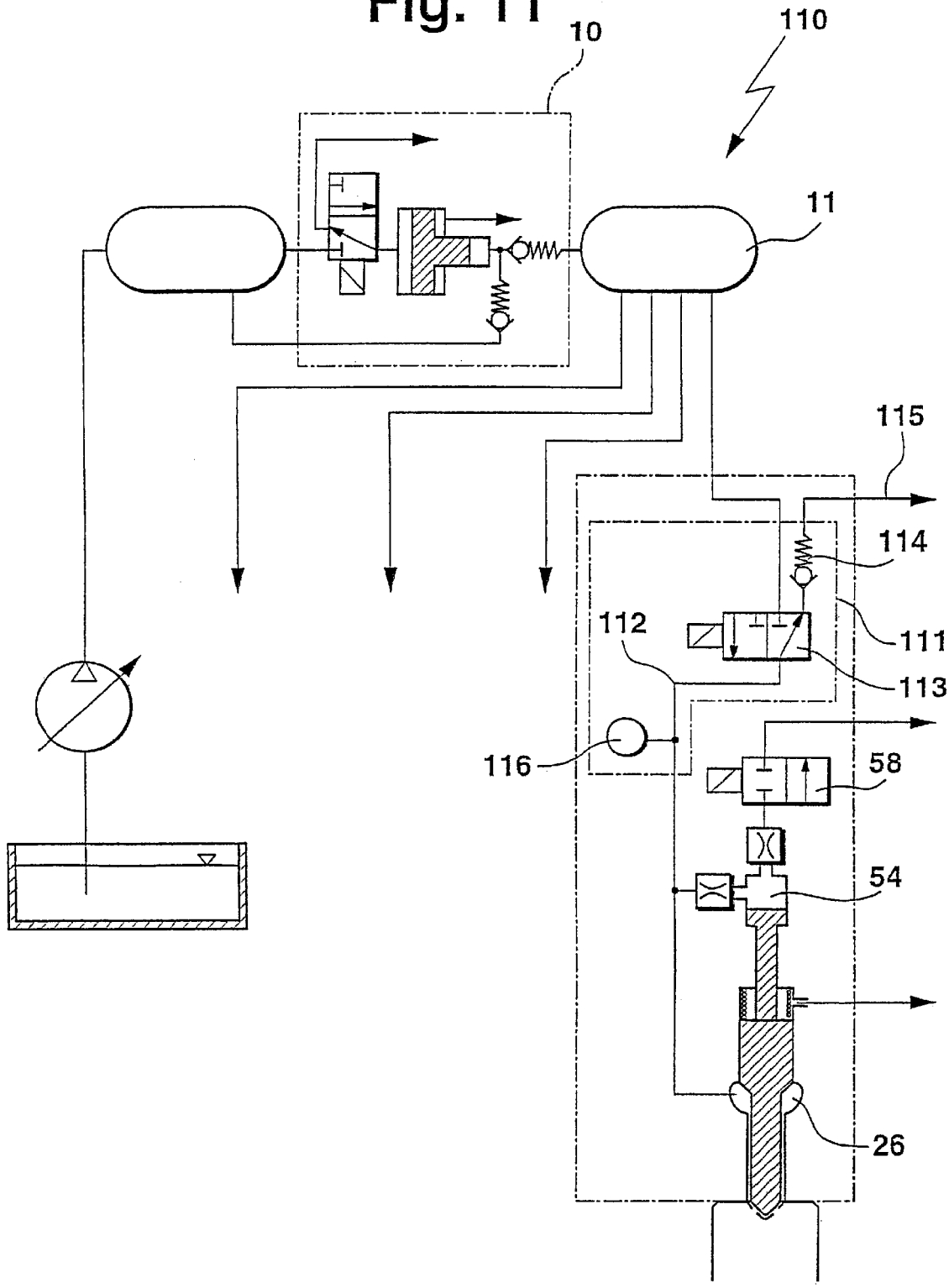
FIG. 11 illustrates a stroke-controlled fuel injection system corresponding to FIG. 8, with a modified local diversion unit.

The stroke-controlled injection system 110 of FIG. 11 corresponds to the injection system 80 (FIG. 8), but with a differently constructed local diversion unit 111. Its pressure line 112 can either be connected directly to the second pressure reservoir 11 by means of a 3/2-way valve 113 or be made to communicate with a leakage line 115 that contains a pressure limiting valve 114. The connection to the second pressure reservoir 11 is used for the main injection and the simultaneous filling of an accumulator chamber 116. While this connection exists, fuel at the higher fuel pressure can fill the control chamber 54 and the nozzle chamber 26. During the pre-injection and the post-injection, the pressure line 112 communicates constantly with the leakage line 115. The pressure limiting valve 114 opens above a pressure of 300 bar, for example, so that the fuel flowing out of the accumulator chamber 116 is lowered to this lower fuel pressure. The onset and end of the main injection and of the pre-injection and post-injection can be controlled by means of the 2/2-way valve 58.

Figure 12A:
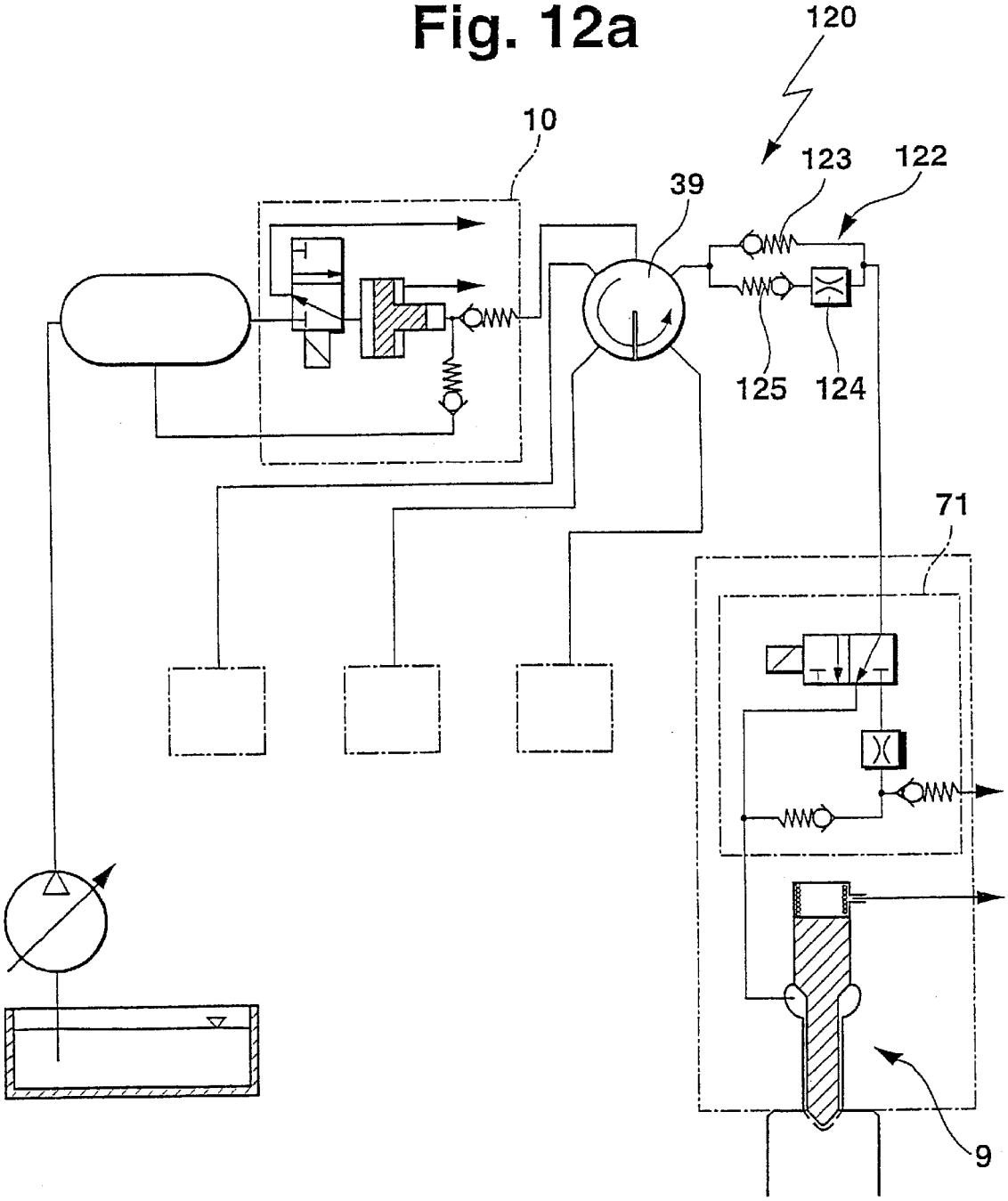
FIGS. 12*a* and 12*b* schematically illustrate a pressure-controlled fuel injection system, corresponding to FIG. 7, but without the second pressure reservoir, and in which the applicable fuel pressure is metered by means of a central distributor device.
Figure 12B:
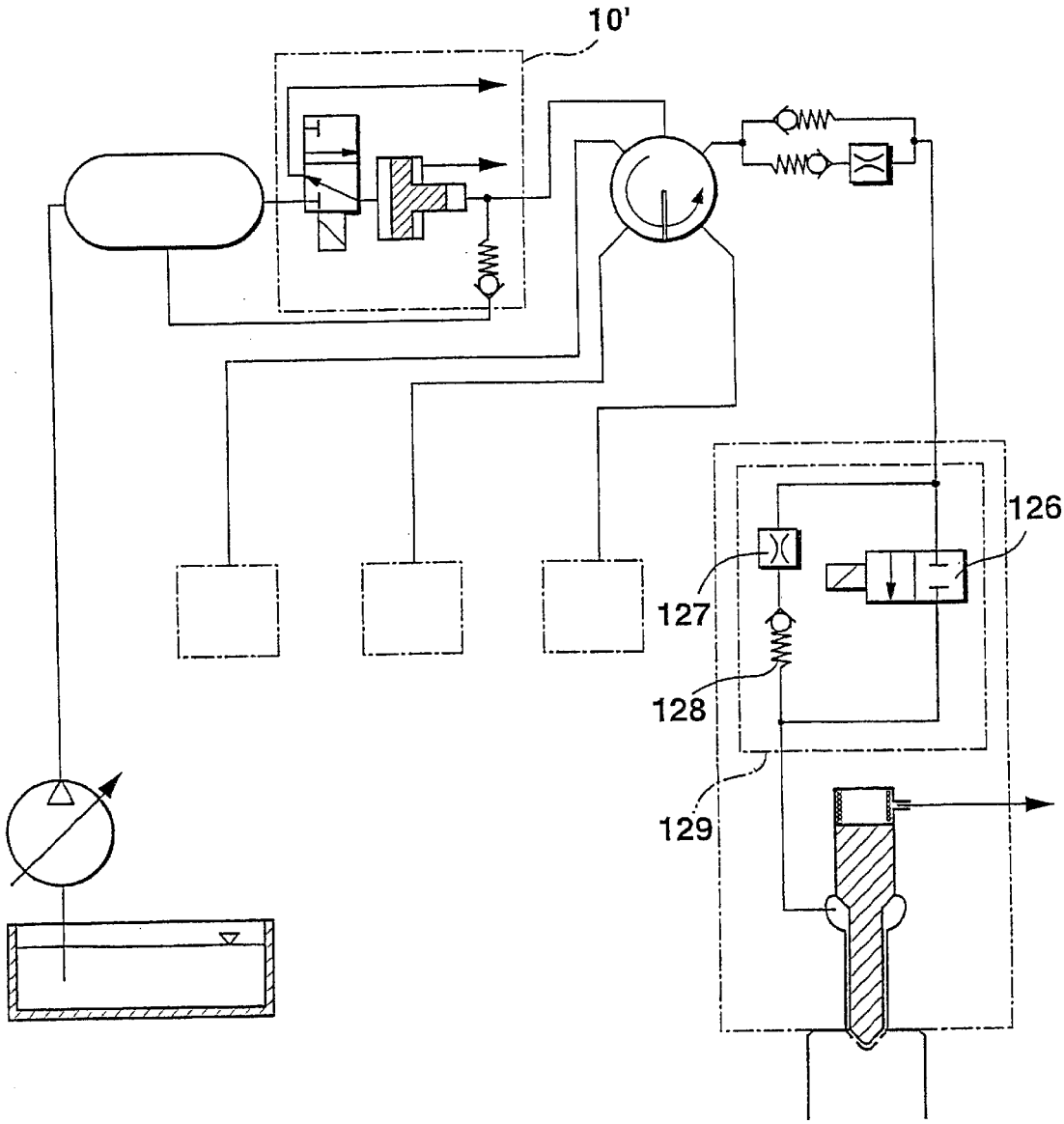

In the pressure-controlled injection system 120 shown in FIGS. 12*a* and 12*b*, without a second pressure reservoir, the central distributor device 39 distributes the higher fuel pressure, generated by means of the central pressure booster unit 10, to the various individual injectors 9. Via the local diversion unit 71, already described above, the higher fuel pressure can then either be switched through for an injection or lowered dissipatively to a lower fuel pressure. Downstream of the distributor device 39, one check valve assembly 122 for each injector 9 is also provided, which allows the fuel to flow in the direction of the injector 9 via a first check valve 123 and which permits the return flow of fuel out of the injector 9 by means of a throttle 124 and a second check valve 125 in order to relieve the distributor device 39 and reduce the pressure.

In the exemplary embodiment of FIG. 12*b*, via a 2/2-way valve 126, either the higher fuel pressure can be switched through, or a lower fuel pressure can be generated via a throttle 127; a check valve 128 prevents a return flow via the throttle 127. The parts 126, 127 and 128 form the local pressure limiting or throttle unit, identified overall by reference numeral 129. Unlike what is shown in FIG. 1, here the central pressure booster unit 10' is embodied without a check valve 15.

Figure 13A:
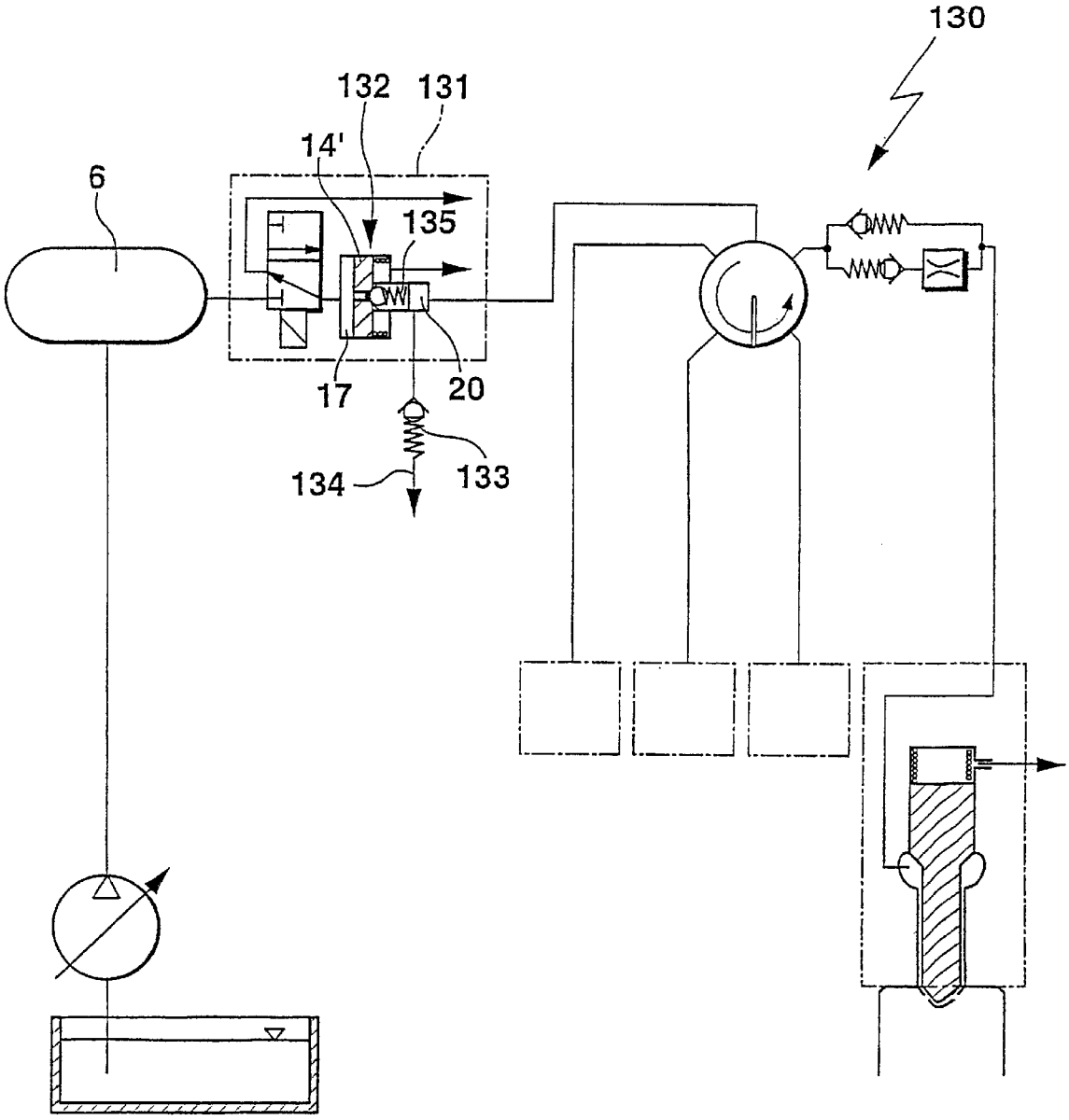
FIGS. 13*a*, 13*b*, 13*c*, 13*d*, and 13*e* illustrate various pressure-controlled fuel injection systems corresponding to FIG. 12, but each with a respective modified central pressure booster unit.
Figure 13B:
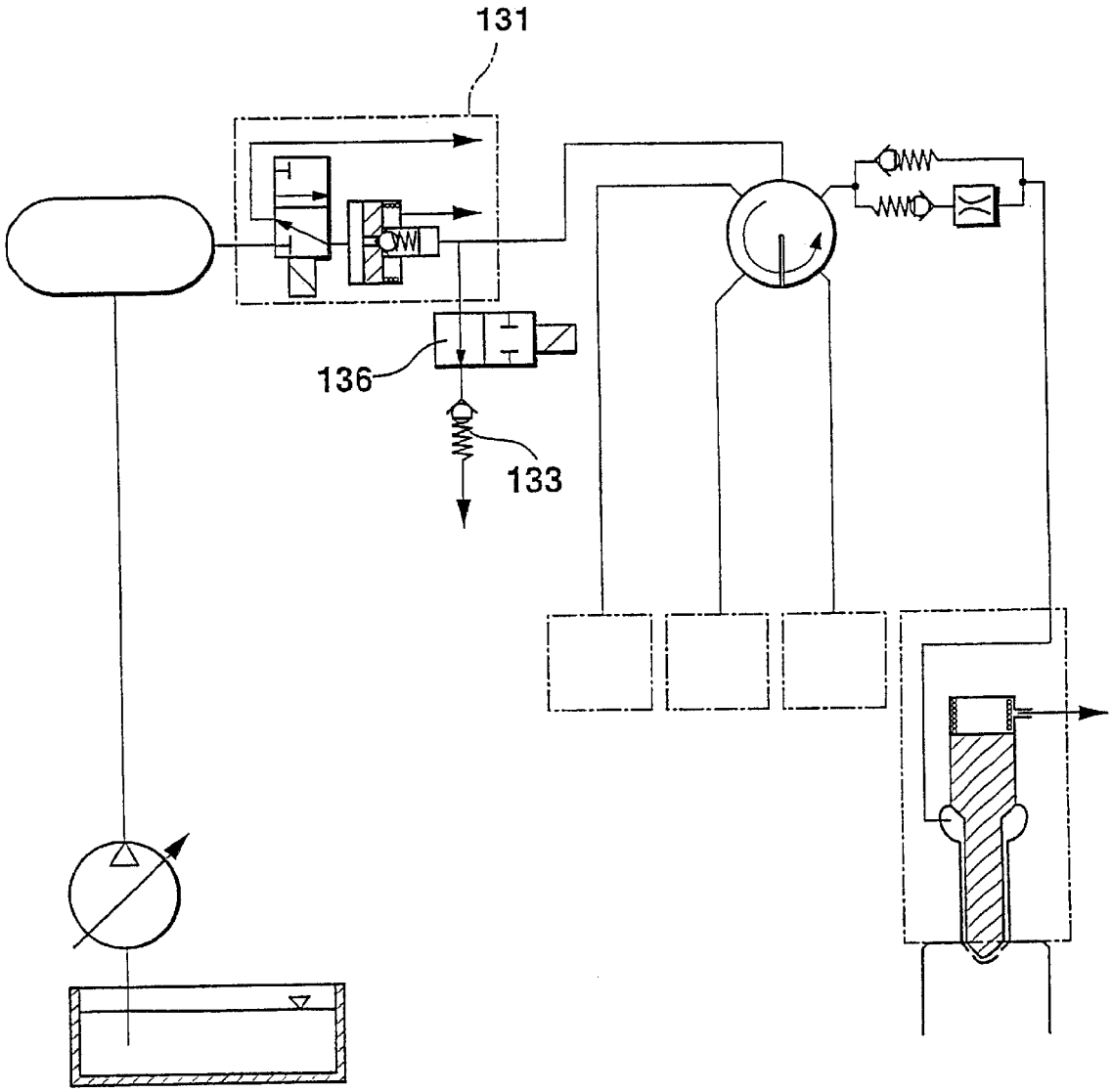
Figure 13C:
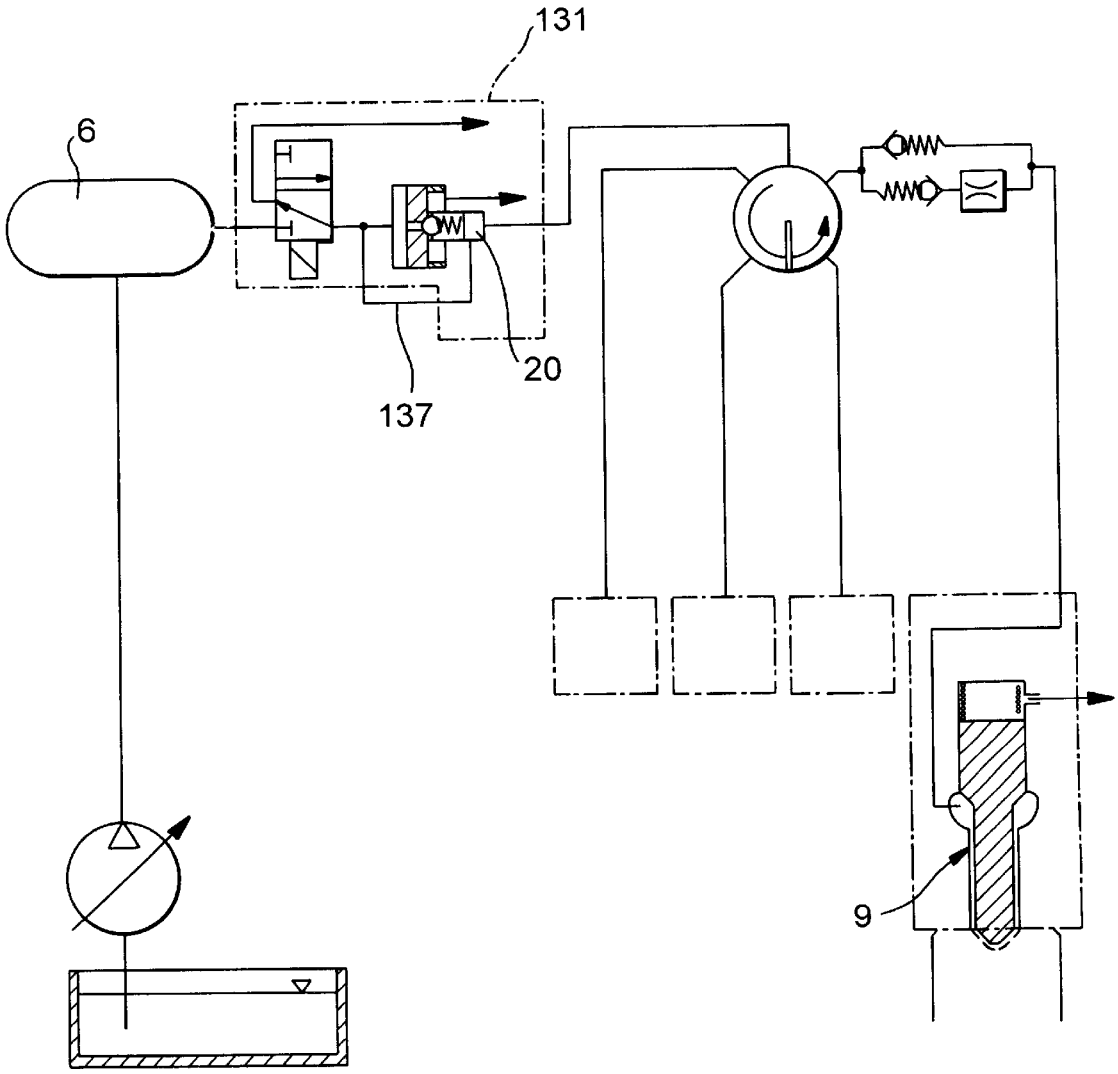
Figure 13D:
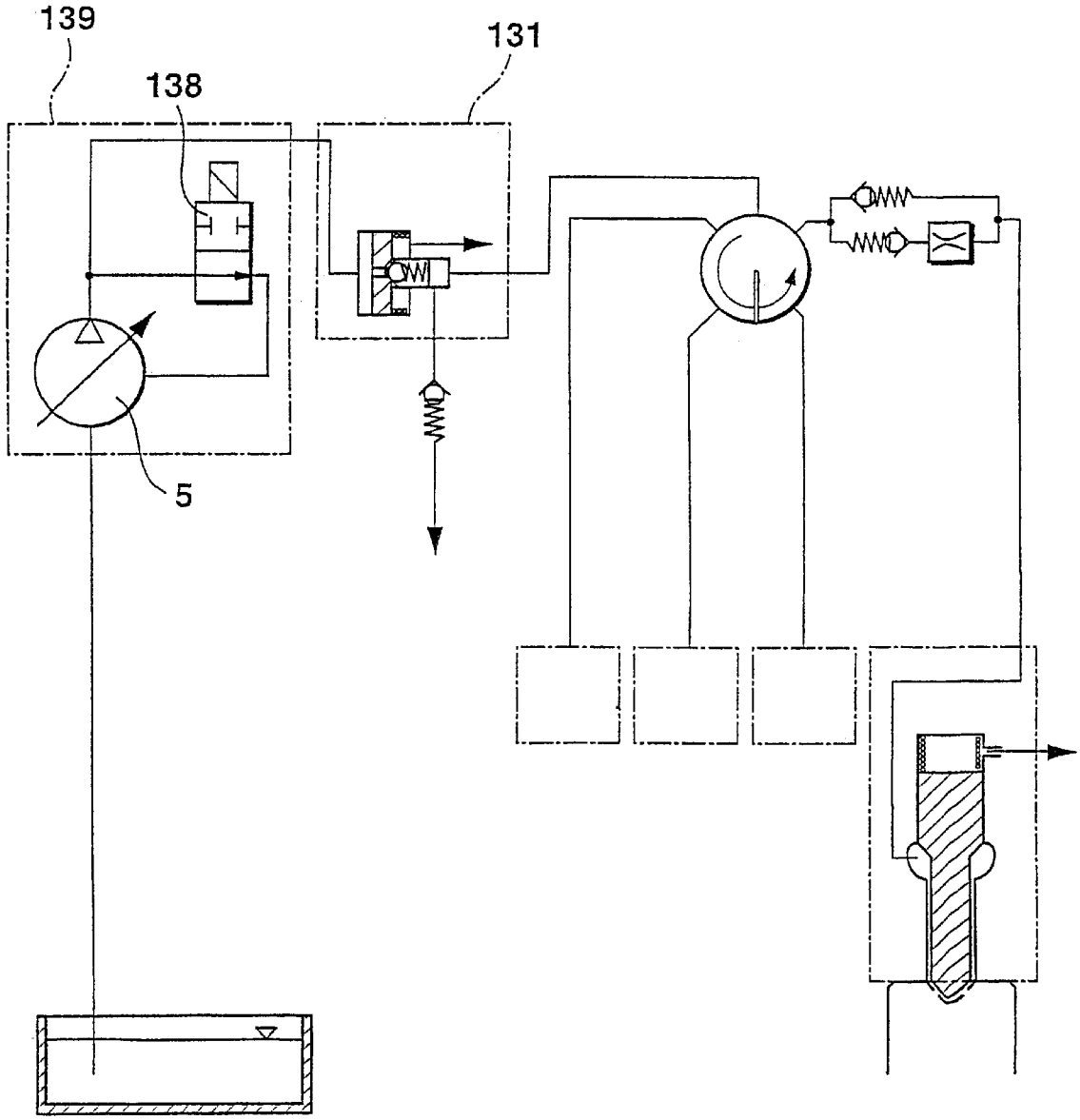
Figure 13E:
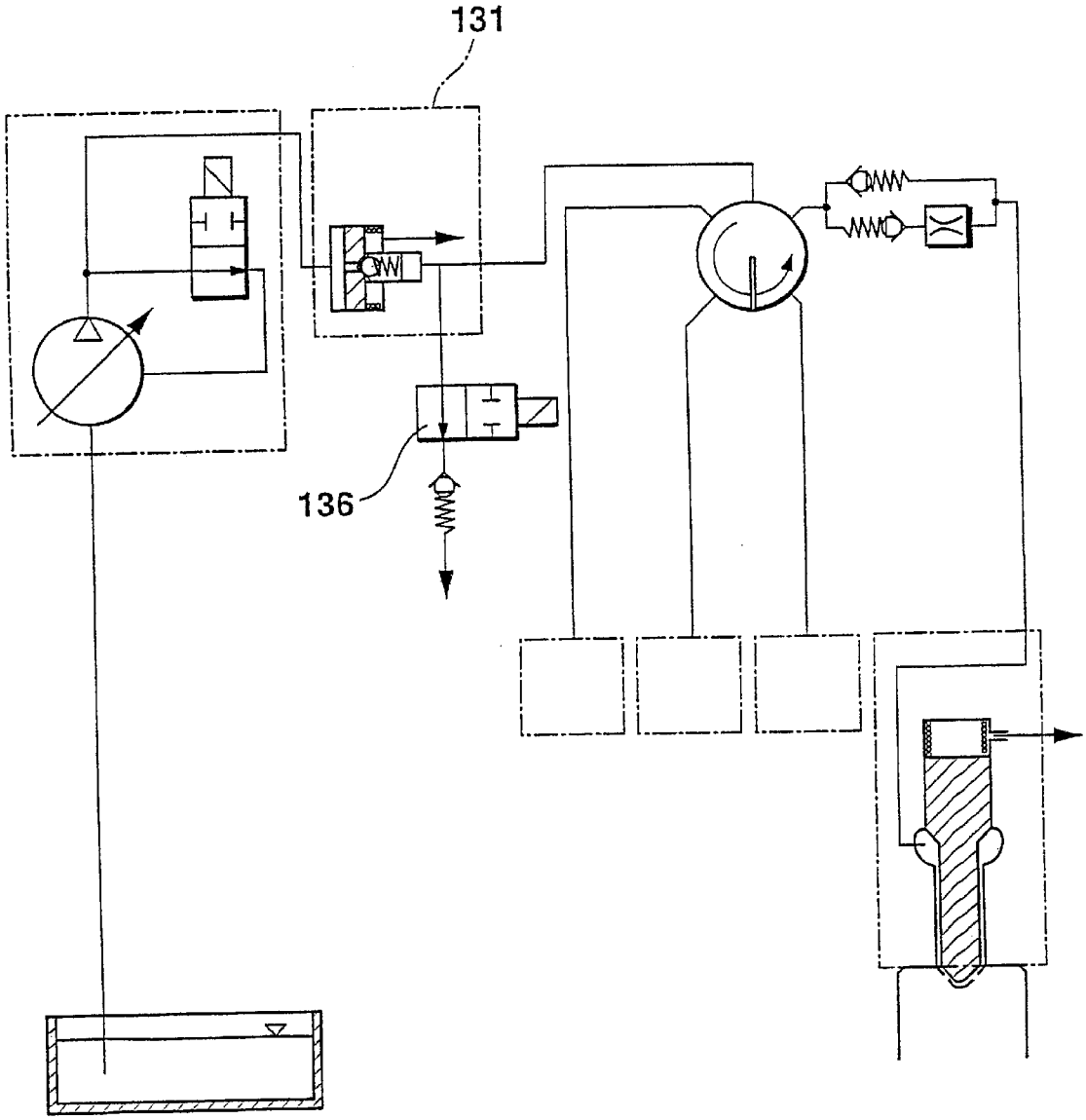

Unlike the injection system 20, the pressure-controlled injection system 130 of FIGS. 13*a* and 13*b*, 13*c*, 13*d*, and 13*e* makes do entirely without local control, since the central pressure booster unit 131 with its pressure booster 132 is used not only to generate the higher fuel pressure but also for throttling to the lower fuel pressure. To that end, the pressure chamber 20 is connected to a leakage line 134 via a pressure limiting valve 133 that is set to the lower fuel pressure, and as a result the injection pressure is initially limited to the lower fuel pressure, such as 300 bar. However, the communication of the pressure chamber 20 and the pressure limiting valve 133 is already closed by the pressure means 14' (pressure booster piston) after only a slight motion thereof. Thus for the ensuing injection event, the higher fuel pressure is available. For refilling the pressure chamber 20, suitable check valves should be provided, and a spring force acting on the pressure means 14' promotes the filling. In the exemplary embodiment shown, the pressure chamber 20 communicates with the primary chamber 17 via a check valve 135 disposed in the pressure means 14'. While in FIG. 13*a* the injection quantity that is injected at the lower fuel pressure is predetermined structurally, this injection quantity, or in other words the pressure level of the pre-injection and the course of the main injection (boot injection), can be controlled by a central diversion unit 136 (2/2-way valve) upstream of the pressure limiting valve 133 (FIG. 13*b*). In another variant (FIG. 13*c*), the pressure chamber 20 can also be made to communicate via the line 137 directly with the pressure reservoir 6, so that its fuel is carried onward to the pressure-controlled injectors 9 for an injection at the lower fuel pressure. As a result, the outflowing leakage quantities can be reduced. In the exemplary embodiment of FIG. 13*d*, the pressure reservoir 6 of FIG. 13*a* is omitted, and the pressure buildup takes place by the supply of current to a 2/2-way valve 138. The high-pressure pump 5 can generate a fuel pressure of approximately 300 to approximately 1000 bar and can for instance be a cam pump. The high-pressure pump 5 and the 2/2-way valve 138 form the pressure unit 139. As shown in FIG. 13*e*, the injection can additionally be controlled—as in FIG. 13*b*—by the diversion unit 136.

Figure 14:
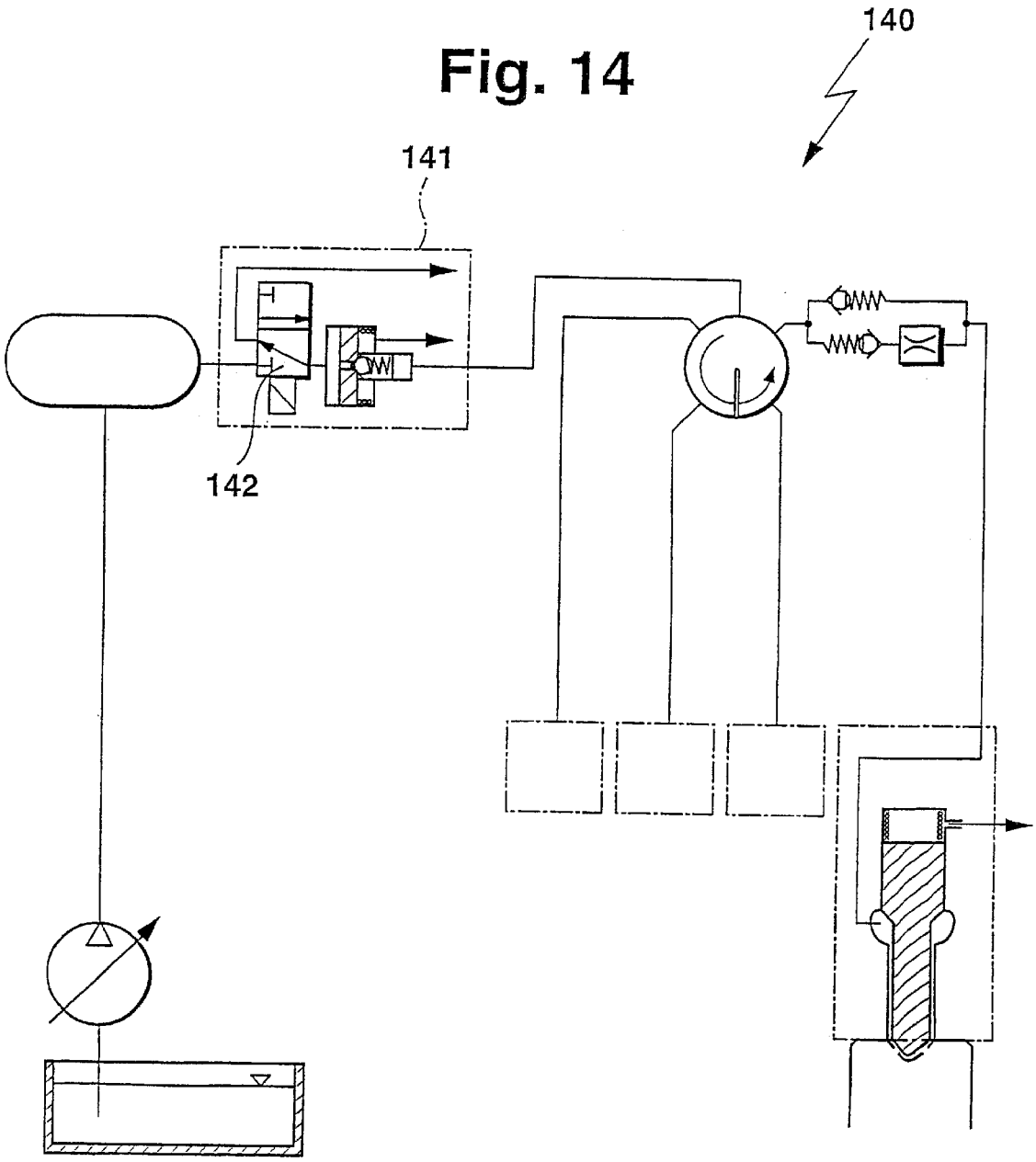
FIG. 14 illustrates a pressure-controlled fuel injection system, corresponding to FIG. 13*c*, with a piezoelectric valve unit in the central pressure booster unit.

The pressure-controlled injection system 140 shown in FIG. 14, which otherwise corresponds to the injection system of FIG. 13*c*, includes in its pressure booster unit 141 a piezoelectric valve unit 142, whose valve cross section is controlled by means of a piezoelectric final control element (actuator), or a fast-switching magnet valve. The piezoelectric actuators, which have a requisite temperature compensation and optionally a requisite force or travel boosting function, serve to control the cross section and thus to shape the course of injection. A completely independent pre-injection in terms of both time and injection quantity as well as injection pressure becomes possible. The main injection can be adapted entirely flexibly to any desired course of injection and additionally makes a split injection or post-injection possible, which can be stored arbitrarily close to the main injection.

Figure 15A:
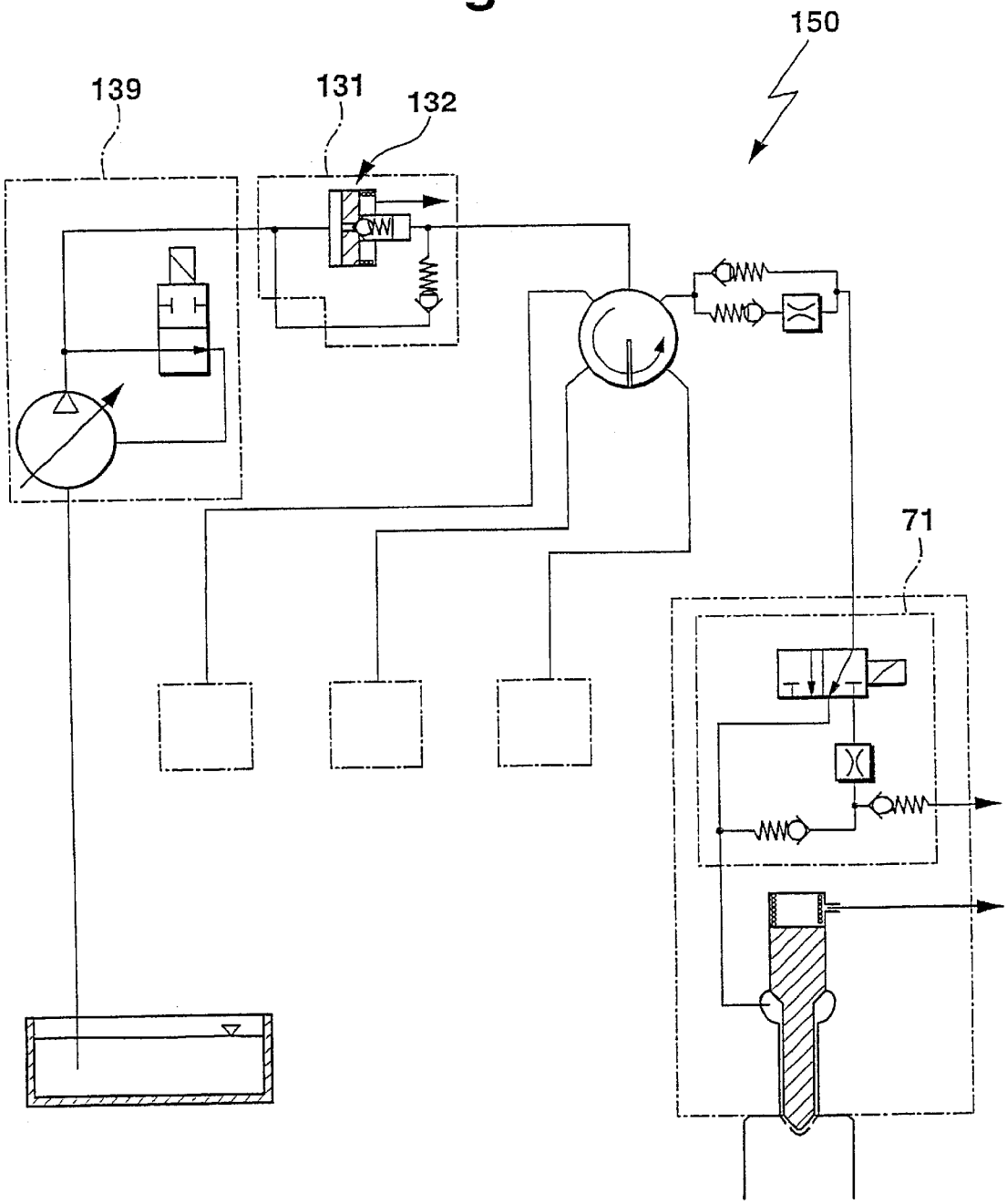
FIGS. 15*a* and 15*b* illustrate a pressure-controlled injection system corresponding to FIG. 12, but without pressure reservoirs and with a modified central pressure booster unit.
Figure 15B:
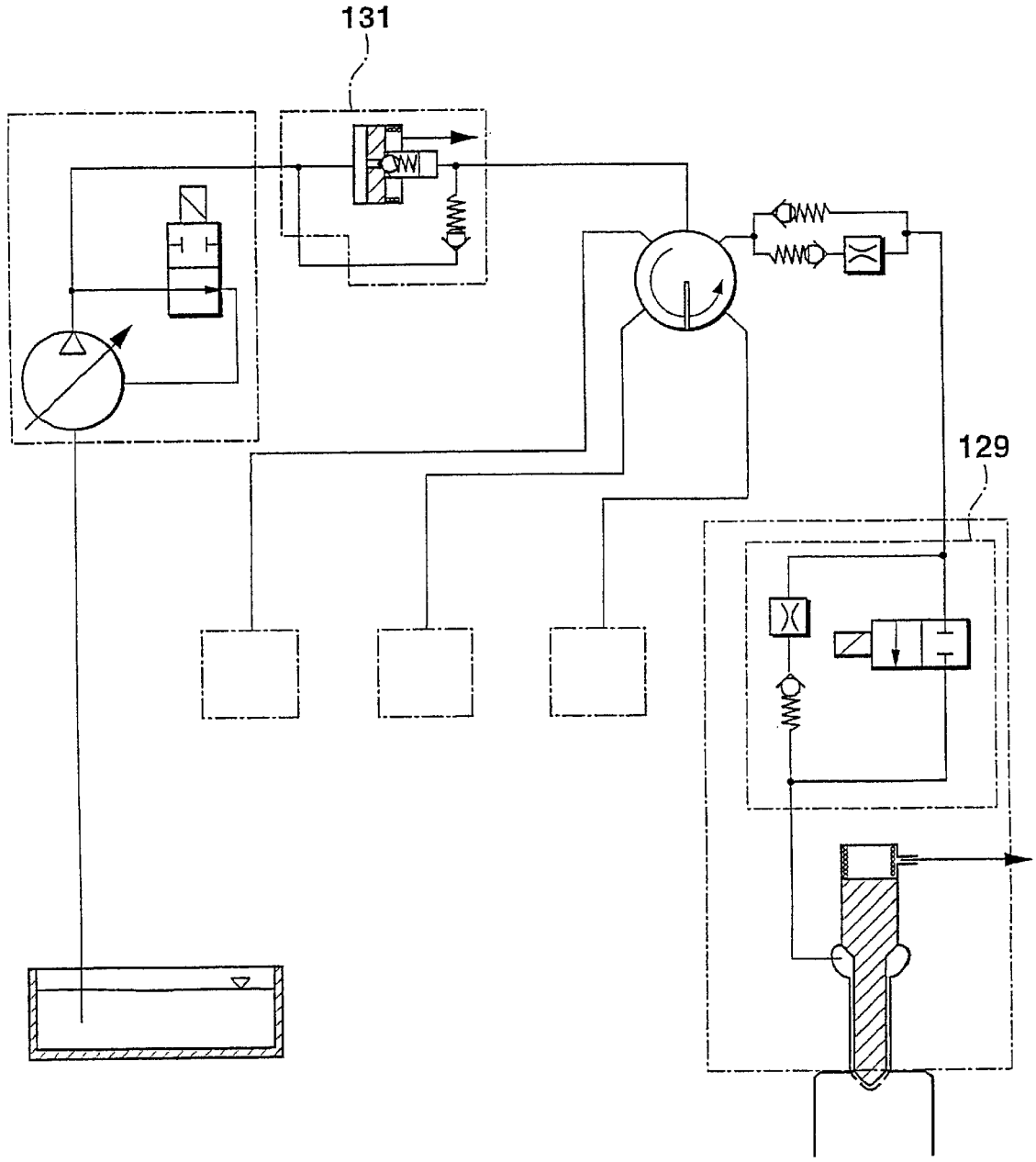

The pressure-controlled injection system 150 of FIGS. 15*a* and 15*b*, based on the injection system of FIGS. 12*a* and 12*b*, uses the pressure unit 139 for generating a pressure of about 200 bar to about 1000 bar as an operating medium for the central pressure booster unit 151, which is formed solely by the pressure booster 132 (FIG. 13*a*). The reduction to the lower fuel pressure is effected in FIG. 15*a* by means of the local diversion unit 71 (FIG. 7), which has a pressure limiting valve, and in FIG. 15*b* by means of the local pressure limiting or throttling unit 129 (FIG. 12*b*).

Figure 16A:
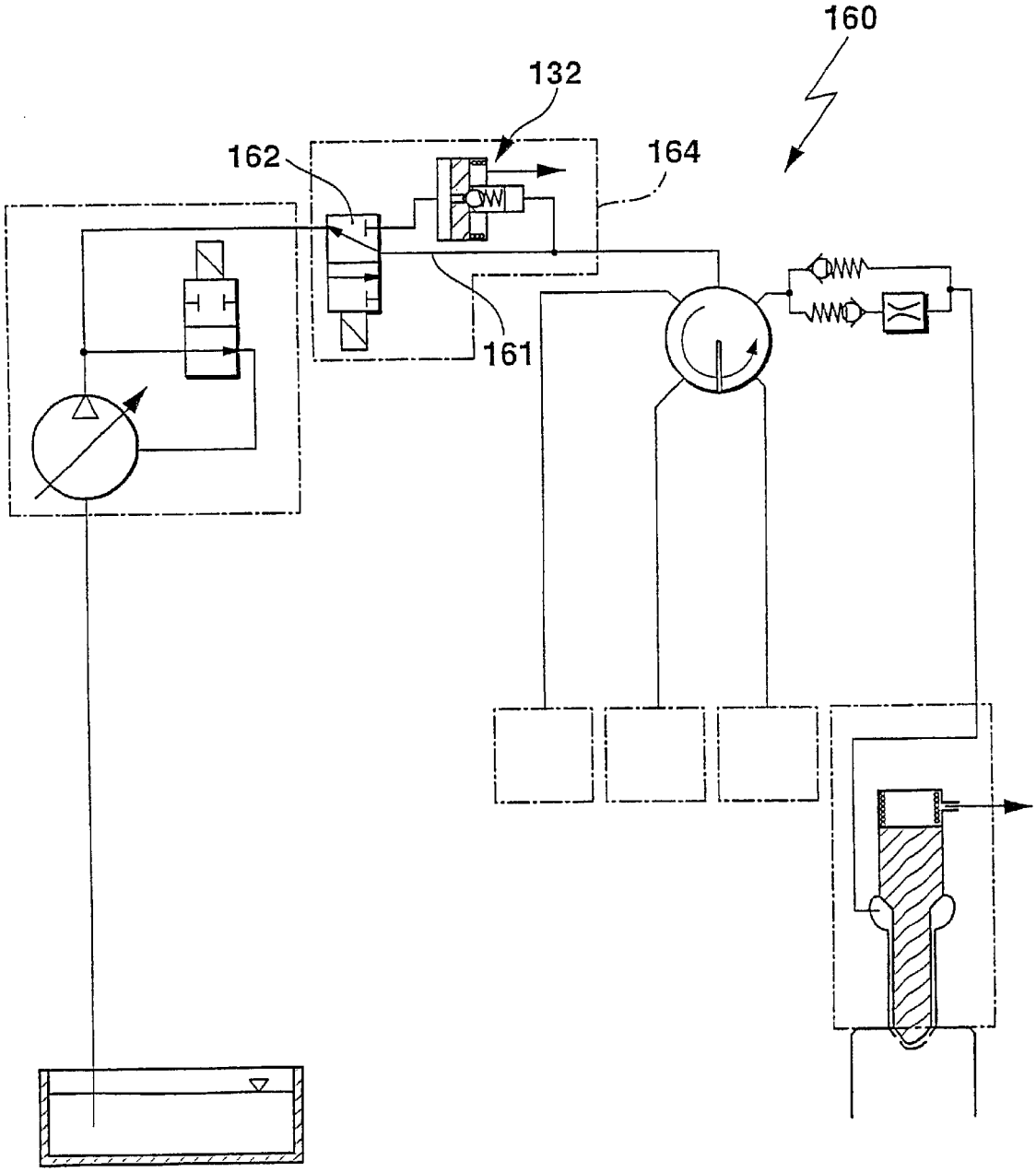
FIGS. 16*a* and 16*b* illustrate a fuel injection system corresponding to FIG. 15, but with a modified central pressure booster unit and without any local diversion unit.
Figure 16B:
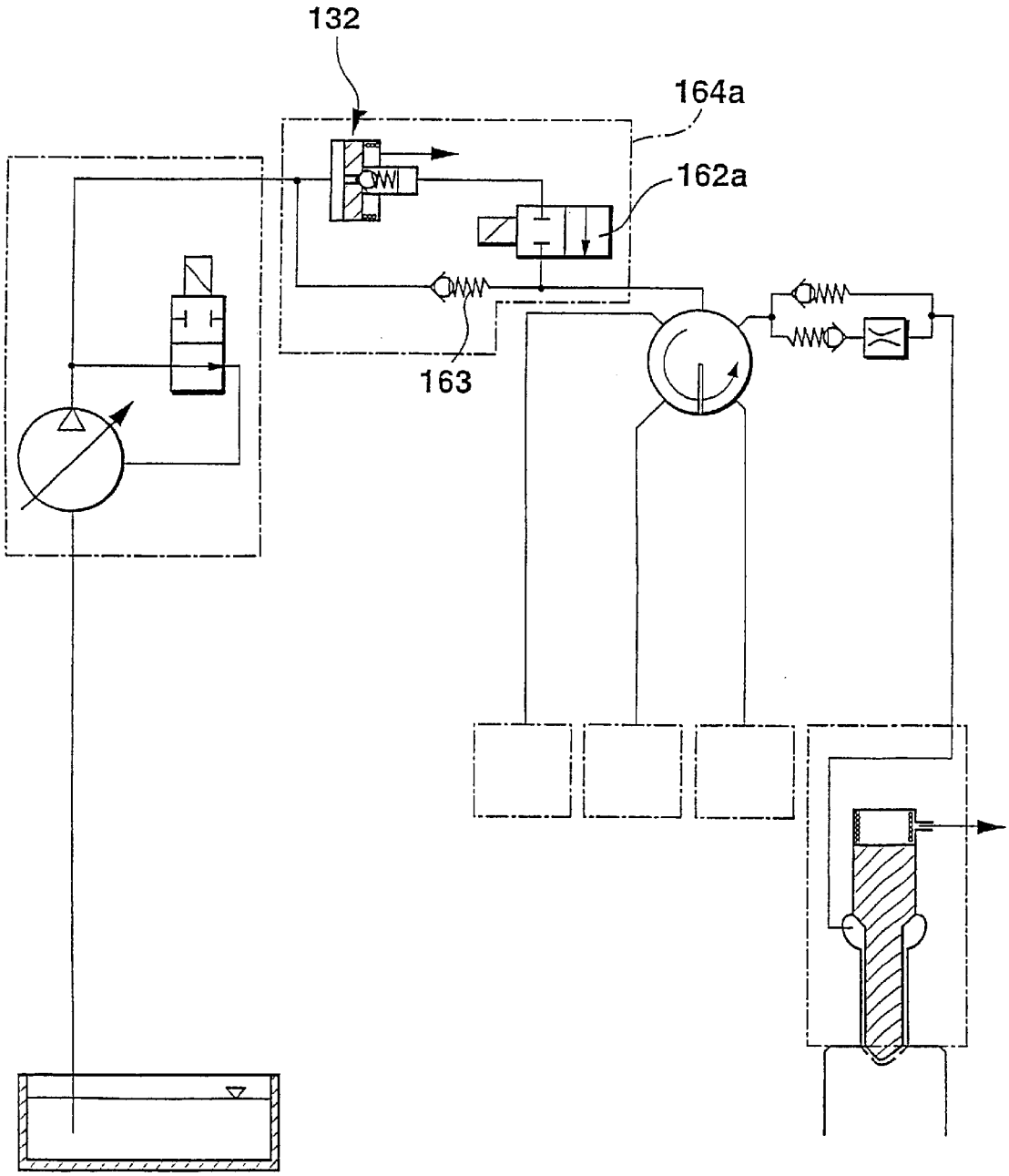

The pressure-controlled injection system 160 of FIGS. 16*a* and 16*b* differs from that of FIG. 13*d* in that the central pressure booster 132 can be circumvented by a parallel bypass line 161 and is actuatable and deactuatable by means of a valve unit 162 (FIG. 16*a*) or 162*a* (FIG. 16*b*). In FIG. 16*a*, the valve unit 162 is upstream of the pressure booster 132 and is embodied as a 3/2-way valve; in FIG. 16*b*, the valve unit 162*a* is downstream of the pressure booster 132 and embodied as a 2/2-way valve, which is decoupled via a check valve 163. The parts 132, 161, 162 on the one hand and 132, 162*a*, 163 on the other form the respective central pressure booster unit 164 and 164*a*.

Figure 17:
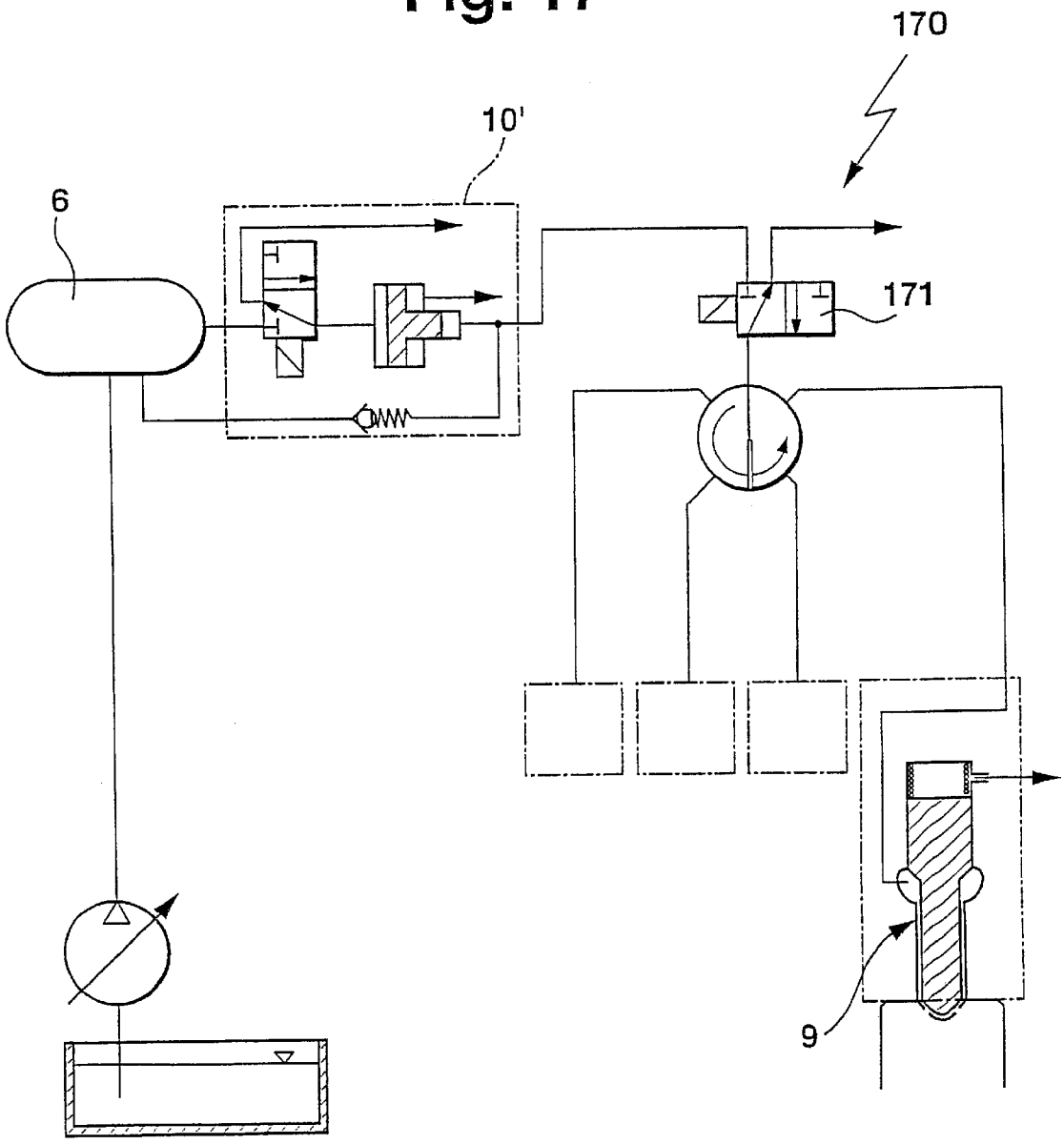
FIG. 17 schematically illustrates a further pressure-controlled fuel injection system with a central pressure booster unit between a central pressure reservoir and a central distributor device.

In the pressure-controlled injection system 170 shown in FIG. 17, either the lower fuel pressure stored in the central pressure reservoir 6 or the higher fuel pressure, generated as needed via the central pressure booster unit 10', is distributed centrally to the individual injectors 9. The injection at the applicable fuel pressure is controlled via the central valve unit 171 (3/2-way valve), which in its function corresponds to the valve unit 37 (FIG. 2*a*).

The valve units shown in the drawings can each be actuated by electromagnets for opening or closing or for switchover. The electromagnets are triggered by a control unit, which is capable of monitoring and processing various operating parameters (engine rpm, etc.) of the engine to be supplied. Instead of magnet-controlled valve units, piezoelectric final control elements (actuators) can also be used, which have a requisite temperature compensation and optionally a requisite force or travel boost (see earlier note).

In a fuel injection system 1 for an internal combustion engine, in which the fuel pumped by means of a high-pressure pump 5 can be injected into the combustion chamber 8 of the engine at at least two different, high fuel pressures via injectors 9, between the high-pressure pump 5 and the injectors 9, at least one central pressure booster unit 10 for all the injectors 9 is provided. The pressure booster unit is triggerable in a targeted way as needed, and as a result the fuel which is at the higher pressure can be better regulated in quantity, and the losses from friction can be reduced accordingly as well.

The foregoing relates to preferred exemplary embodiments of the invention, it being understood that other variants and embodiments thereof are possible within the spirit and scope of the invention, the latter being defined by the appended claims.

What is claimed is:

1. In a fuel injection system (1; 50; 70; 80; 90; 100; 110; 120; 130; 140; 150; 160; 170) for an internal combustion engine, in which the fuel pumped by means of a high-pressure pump (2) (5) can be injected into the combustion chamber (8) of the engine at at least two different, high fuel pressures via injectors (9; 51), the improvement comprising;

between the high-pressure pump (5) and the injectors (9; 51), at least one central pressure booster unit (10; 10'; 131; 141; 164; 164*a*) for all the injectors (9; 51) is provided, said central pressure booster unit is preceded by a pressure reservoir (6) and is followed by a pressure reservoir (11), wherein each injector (9; 51) is assigned a central valve unit (22; 22*a*; 22*b*) or a local valve unit (41; 72; 93; 113; 126), by means of which a switchover can be made between the two fuel pressures.

2. The fuel injection system of claim 1, wherein at least a check valve (15, 16; 135; 163) is assigned to each central pressure booster unit (10; 10'; 131; 141; 164; 164*a*) and enables refilling of the pressure booster unit (10; 10'; 131; 141; 164; 164*a*) and/or decouples a higher fuel pressure from a lower fuel pressure.

3. The fuel injection system of claim 2, wherein the central pressure booster unit (10; 10'; 131; 141; 164; 164*a*) is followed by a central distributor device (39), which distributes the fuel to the individual injectors (9; 51).

4. The fuel injection system of claim 1, wherein the central pressure booster unit (10; 10'; 131; 141; 164; 164*a*) is followed by a central distributor device (39), which distributes the fuel to the individual injectors (9; 51).

5. The fuel injection system of claim 1, wherein each injector (9; 51) is assigned at least one local pressure booster unit (96) for generating the higher fuel pressure from the lower fuel pressure.

6. The fuel injection system of claim 1, wherein the central pressure booster unit (164*a*) and/or the local pressure booster unit (96) has a pressure booster (132; 91) that can be switched on and off and that is disposed parallel to a bypass line (161; 92).

7. The fuel injection system of claim 1, wherein for generating the lower fuel pressure from the higher fuel pressure, a central diversion unit (136) and/or a local diversion unit (71; 111) is provided.

8. The fuel injection system of claim 1, wherein for generating the lower fuel pressure, the cross section of a valve unit (142) is controllable.

9. The fuel injection system of claim 1, wherein the injectors (9) are embodied for pressure control.

10. The fuel injection system of claim 1, wherein the injectors (51) are embodied for stroke control.

11. The fuel injection system of claim 1, wherein the high-pressure side and the low-pressure side of the central pressure booster unit (10) are hydraulically decoupled from one another.

* * * * *